US011851936B2

(12) United States Patent
Cate et al.

(10) Patent No.: US 11,851,936 B2
(45) Date of Patent: Dec. 26, 2023

(54) SYSTEM AND METHOD FOR MOVABLE BARRIER MONITORING

(71) Applicant: The Chamberlain Group LLC, Oak Brook, IL (US)

(72) Inventors: Casparus Cate, Lombard, IL (US); James Joseph Fitzgibbon, Batavia, IL (US); Thomas J. Grinter, Wheaton, IL (US); Anders K. Melberg, Lindenhurst, IL (US); Robert John Olmsted, Wood Dale, IL (US)

(73) Assignee: The Chamberlain Group LLC, Oak Brook, IL (US)

( * ) Notice: Subject to any disclaimer, the term of this patent is extended or adjusted under 35 U.S.C. 154(b) by 433 days.

(21) Appl. No.: 16/992,653

(22) Filed: Aug. 13, 2020

(65) Prior Publication Data

US 2021/0047873 A1 Feb. 18, 2021

Related U.S. Application Data

(60) Provisional application No. 62/924,861, filed on Oct. 23, 2019, provisional application No. 62/887,299, filed on Aug. 15, 2019.

(51) Int. Cl.
*E05F 15/40* (2015.01)
*G07C 9/00* (2020.01)
(Continued)

(52) U.S. Cl.
CPC ..... *E05F 15/686* (2015.01); *G07C 9/00896* (2013.01); *E05Y 2400/30* (2013.01);
(Continued)

(58) Field of Classification Search
CPC ..... E05F 15/686; G07C 9/00896; G07C 2009/00928; E05Y 2400/30;
(Continued)

(56) References Cited

U.S. PATENT DOCUMENTS 5,706,875 A 1/1998 Simon
5,743,046 A 4/1998 Siegler
(Continued)

OTHER PUBLICATIONS

CN 108266086 A Machine Translation; Lan, Hong-Wei (Year: 2017).*
(Continued)

*Primary Examiner* — Jorge L Carrasquillo
(74) *Attorney, Agent, or Firm* — Fitch, Even, Tabin & Flannery LLP

(57) ABSTRACT

In one aspect of the present disclosure, a movable barrier operator system is provided that includes a motor configured to turn a drum to pay out a cable from the drum and permit a door connected to the cable to move from an open position toward a closed position. The system includes a memory configured to store an expected variable of the door, and a sensor configured to detect movement of the door. The system further includes a processor circuit operatively coupled to the motor, the memory, and the sensor. The processor circuit is configured to: use the sensor to estimate an actual variable of the door; determine whether the actual variable is acceptable based at least in part on the expected variable and the processor circuit causing the motor to turn the drum; and change operation of the movable barrier upon the actual variable of the movable barrier being unacceptable.

26 Claims, 10 Drawing Sheets

(51) Int. Cl.

| | |
|---|---|
| ***E05F 15/686*** | (2015.01) |
| *E06B 9/70* | (2006.01) |
| *E06B 3/48* | (2006.01) |
| *E06B 3/70* | (2006.01) |

(52) U.S. Cl.
CPC ..... *E05Y 2400/52* (2013.01); *E05Y 2900/106* (2013.01); *E05Y 2900/11* (2013.01); *E06B 3/485* (2013.01); *E06B 9/70* (2013.01); *E06B 2003/7044* (2013.01); *G07C 2009/00928* (2013.01)

(58) Field of Classification Search
CPC ..... E05Y 2400/52; E05Y 2900/106; E05Y 2900/11; E05Y 2400/44; E06B 3/485; E06B 9/70; E06B 2003/7044; E06B 1/522; E06B 9/68; E06B 2009/6818
USPC ..... 318/461
See application file for complete search history.

(56) References Cited

U.S. PATENT DOCUMENTS

| | | | | |
|---|---|---|---|---|
| 6,014,307 | A | 1/2000 | Crimmins | |
| 6,051,947 | A | 4/2000 | Lhotak | |
| 6,782,662 | B2 | 8/2004 | McCartney | |
| 6,842,112 | B2 | 1/2005 | Pulis | |
| 6,883,579 | B2 | 4/2005 | Olmsted | |
| 6,895,355 | B2 | 5/2005 | Fitzgibbon | |
| 7,154,531 | B2 | 12/2006 | Laird | |
| 7,221,288 | B2 | 5/2007 | Fitzgibbon | |
| RE40,001 | E | 1/2008 | Siegler | |
| 7,805,977 | B2 | 10/2010 | Study | |
| 8,113,263 | B2 | 2/2012 | Reed | |
| 9,057,779 | B2 | 6/2015 | Pfiffner | |
| 9,122,254 | B2 | 9/2015 | Cate | |
| 9,217,283 | B2 | 12/2015 | Olmsted | |
| 9,576,449 | B2 | 2/2017 | Smith | |
| 10,204,466 | B1 | 2/2019 | Rothmuller | |
| 10,358,317 | B2 | 7/2019 | Laird | |
| 2009/0115366 | A1* | 5/2009 | Mullet | E05F 15/41 310/75 R |
| 2010/0319256 | A1 | 12/2010 | Agam | |
| 2012/0137585 | A1 | 6/2012 | Brown | |
| 2014/0331557 | A1 | 11/2014 | Bruns | |
| 2016/0063778 | A1 | 3/2016 | Bruns | |
| 2016/0063783 | A1 | 3/2016 | Bruns | |
| 2017/0002596 | A1 | 1/2017 | Laird | |
| 2019/0003240 | A1 | 1/2019 | Hoang | |

OTHER PUBLICATIONS

WO 9908956 A1, Date Published: Feb. 25, 1999, "Cable Slack Detector" Inventor: Delaney Charles E (Year: 1999).*
ADAFRUIT VL53LOX Time of Flight Distance Sensor—30; 2016; 4 pages.
Broadcom AFBR-S50MV85G—Tlme-of-Flight sensor Module for Distance and Motion Measurement; Preliminary Data Sheet; 18 pages, Oct. 15, 2018.
Garage Door Cable Drums; DDM Garage Doors, Inc.; https://web.archive.org/web/20180612205015/http://ddmgaragedoors.com; Jun. 2008; 8 pages.
L50 Monitored Resistive Large Profile Edge 82ft Roll; Liftmaster; available before the filing date of the priority date; 4 pages.
MyQ-G0302; Additional Door Sensor for myQ Garage and Smart Garage Hub; Home Connectivity with myQ; available before the filing date of the priority date; 5 pages.
MyQ; myQ Smart Garage Door Sensor; Door Sensor Compatability; copyright 2018; 4 pages.
OPT3101(Active); ToF-based long-range proximity and distance sensor analog front end (AFE), 2 pages; Copyright 1995-2018.
Sebastian Bauer, Broadcom; IFPD Marketing; Time-of-Flight Sensor AFBR-S50 w/o NDA, 9 pages; Aug. 11, 2017.
Texas Instruments; Accurate Distance Measurements with a Highly Integrated ToF Position Sensor; SBOA342—Feb. 2019; 3 pages.
Texas Instruments; Introduction to Time-of-Flight Long Range Proximity and Distance Sensor System Design; SBAU305A—Mar. 2018—Revised Jun. 2018; 46 pages.
Texas Instruments; OPT3101 ToF-Based Long-Range Proximity and Distance Sensor AFE; SBAS883A—Feb. 2018—Revised Jun. 2018; 120 Pages.
Texas Instruments; TI's Proximity Sensing Technology; ; SLYU054; Copyright 2019; 2 pages.
VL53LOX—World Smallest Time-of-Flight (ToF) Ranging Sensor; 5 pages; copyright 2019 STMicroelectronics.
VL53LOX—World's Smallest Time of-Flight (ToF) Ranging and Gesture Detection Sensor; 40 pages; STIife. augmented; Apr. 2018.

* cited by examiner

SYSTEM AND METHOD FOR MOVABLE BARRIER MONITORING

CROSS-REFERENCE TO RELATED APPLICATIONS

This application claims the benefit of U.S. Provisional Application No. 62/887,299, filed Aug. 15, 2019, entitled "SYSTEM AND METHOD FOR MOVABLE BARRIER MONITORING" and U.S. Provisional Application No. 62/924,861, filed Oct. 23, 2019, entitled "SYSTEM AND METHOD FOR MOVABLE BARRIER MONITORING," which are incorporated by reference in their entireties herein.

FIELD

The present disclosure generally relates to systems and methods for monitoring movable barriers and, more specifically, relates to systems and methods of using a sensor to determine movement of a movable barrier.

BACKGROUND

Movable barrier operators may be used to control access to areas by moving movable barriers between different positions. A movable barrier operator may estimate one or more variables of the movable barrier such as position and speed by detecting movement of a motive component (e.g. motor shaft or a transmission) of the movable barrier operator. However, the estimated properties of the movable barrier may diverge from the actual properties of the movable barrier due to the installation of the movable barrier operator, obstructions in the path of the movable barrier, and/or changes over time to the behavior of the movable barrier.

For example, a jackshaft-style movable barrier operator may be installed in a warehouse or garage to control the position of a movable door. The jackshaft operator generally includes an output shaft connected to a counterweight shaft of the movable door. The counterweight shaft is connected to a torsion spring that lifts most of the weight of the door. To control the position of the door, the movable door includes drums mounted on the output shaft and a pair of cables each connected at one end to the drum and at an opposite end to the door. The jackshaft operator turns the output shaft, causing rotation of the drums to either wind up or pay out the cables from the drums and thereby move the door.

In the open position, the door is substantially horizontal. To move the door to the closed position, the movable barrier operator turns the drums to pay out the cables. The door is no longer held in the open position by the cables and begins to move to the closed position due to the effect of gravity on the door. As the garage door moves toward the closed position, more of the garage door is in a vertical position and the weight of the vertical portion of the door pulls the door down with more force. The jackshaft operator turns the drums at a stable speed to pay out the cables from the drums, so the door does not fall at the rate of gravity. However, in some situations, the garage door may remain stationary or may have a very low speed despite the jackshaft operator turning the drums at a controlled speed to pay out the cables from the drums. This may happen for a number of reasons, for example, the system is old and the garage door rollers have increased in friction. Alternatively, the system is newly installed, but the tracks are improperly installed so the weight of the door is insufficient to start the door moving away from the horizontal open position. In these situations, the jackshaft operator continues to release cable to lower the garage door to the ground, but the garage door does not move at the rate of the cables. Without the garage door moving toward the closed position to keep the cables in tension, the cables loosen and may become tangled, criss-crossed, or otherwise come off the cable drums. In this situation, the movement of the garage door is no longer restrained by the cables.

Another problem with jackshaft operators is that drums come in a number of different shapes and profiles that allow an installer to select a drum best suited for the barrier and rail system of a particular application. Indeed, from the perspective of a movable barrier operator manufacturer, the shape and profile of a drum that will ultimately be selected by an installer for a particular application is somewhat unknown. Thus, the ability of the movable barrier operator manufacturer to tailor the jackshaft operator to the drum is difficult and the control logic of the jackshaft operator may be less than optimal in some installations. Although the above discussion highlights jackshaft-style operators, the difficulty with estimating the position, speed, or other properties of a movable barrier is equally challenging for other types of movable barrier operators such as trolley style operators.

To detect a situation where a garage door is not moving despite turning of the drums, cable tension monitors are utilized to sense when a cable is slackened. If the cable tension monitor detects slack in the associated cable, the cable tension monitor sends a signal to the movable barrier operator that causes the moveable barrier operator to slow down, stop or reverse rotation of its output shaft. However, because of the wide variability of garage door installations (including door size, track configuration, drum shape, etc.), the cable tension monitor may need to be installed and adjusted to properly function with each specific system. This may be time-consuming for a professional installer or difficult for a homeowner.

DETAILED DESCRIPTION

Figure 1:
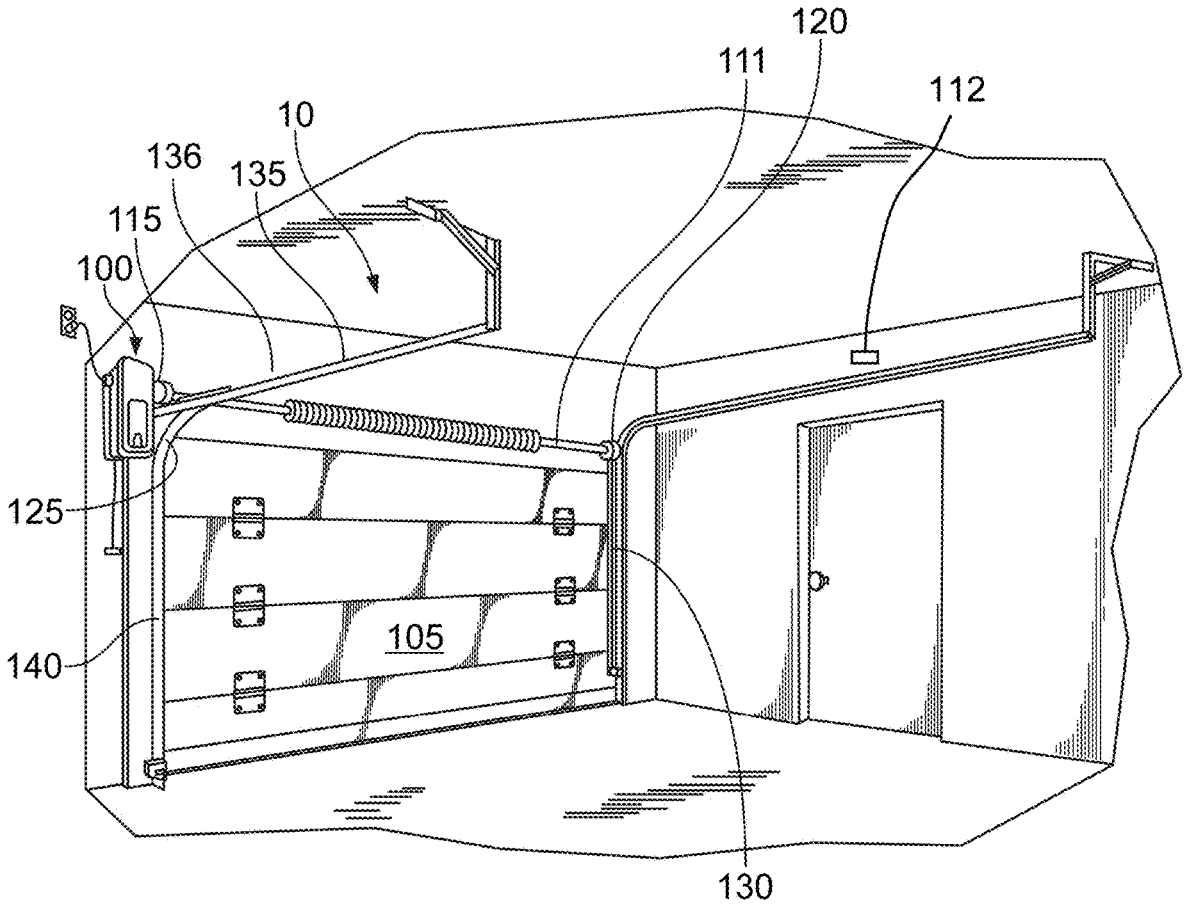
FIG. 1 is a perspective view of an example movable barrier operator system including a movable barrier operator and a movable barrier.

With reference to FIG. 1, an example movable barrier operator system 10 is provided that includes a movable barrier operator 100, such as a garage door opener. The movable barrier operator 100 is configured to move a door of a movable barrier between open and closed positions. The movable barrier may include the door, such as a garage door 105, and components that move the door such as drums 115, 120 and flexible drive members such as chains or cables 125, 130. The movable barrier operator 100 may be configured to move the garage door 105 in response to commands from one or more remote controls such as portable transmitters, a keypad, an in-vehicle transmitter, a wall controller and/or a user device over a network. In the example shown in FIG. 1, the movable barrier operator 100 is a jackshaft-style operator. While a jackshaft-style operator is shown and used as a common example in this disclosure, the subject matter of this disclosure can be employed in other movable barrier operator systems such as garage door opener systems that use a trolley. The movable barrier operator 100 includes a motor 110 (see FIG. 3). The motor 110 has an output shaft coupled to a drive shaft 111 that may also be referred to as a jack shaft. The drums 115, 120 are mounted to the drive shaft 111 and are connected to the cables 125, 130. The motor 110 is configured to turn the drive shaft 111 and drums 115, 120 to wind the cables 125, 130 onto or pay off the cables 125, 130 from the drums 115, 120. The motor 110 may be a component of a variable speed drive of the movable barrier operator 100. The variable speed drive may permit changing of the speed of the motor 110 such as by changing the frequency of electrical power utilized by the motor 110. The motor 110 may have one or more variable associated with operation of the motor 110 such as the frequency of electrical power utilized by the motor 110, current draw of the motor 110, and/or speed of the motor 110.

When the movable barrier operator 100 receives a command to open the garage door 105, the movable barrier operator 100 operates the motor 110 to turn the cable drums 115, 120. The cable drums 115, 120 rotate and wind the cables 125, 130 around the cable drums 115, 120. This causes the garage door 105 to move upward and into an open position.

Once the garage door 105 is in an open position, the garage door 105 is oriented substantially horizontally on horizontal portions 135 of tracks 136 of the garage door 105. When the movable barrier operator 100 receives a command to move the garage door 105 to a closed position, the movable barrier operator 100 operates the motor 110 in the opposite direction. This causes the cables 125, 130 to unwind or pay out from the cable drums 115, 120, and allows the garage door 105 to move downward along vertical portions 140 of the guide rails, being controllably lowered by the cables 125, 130.

Figure 2:
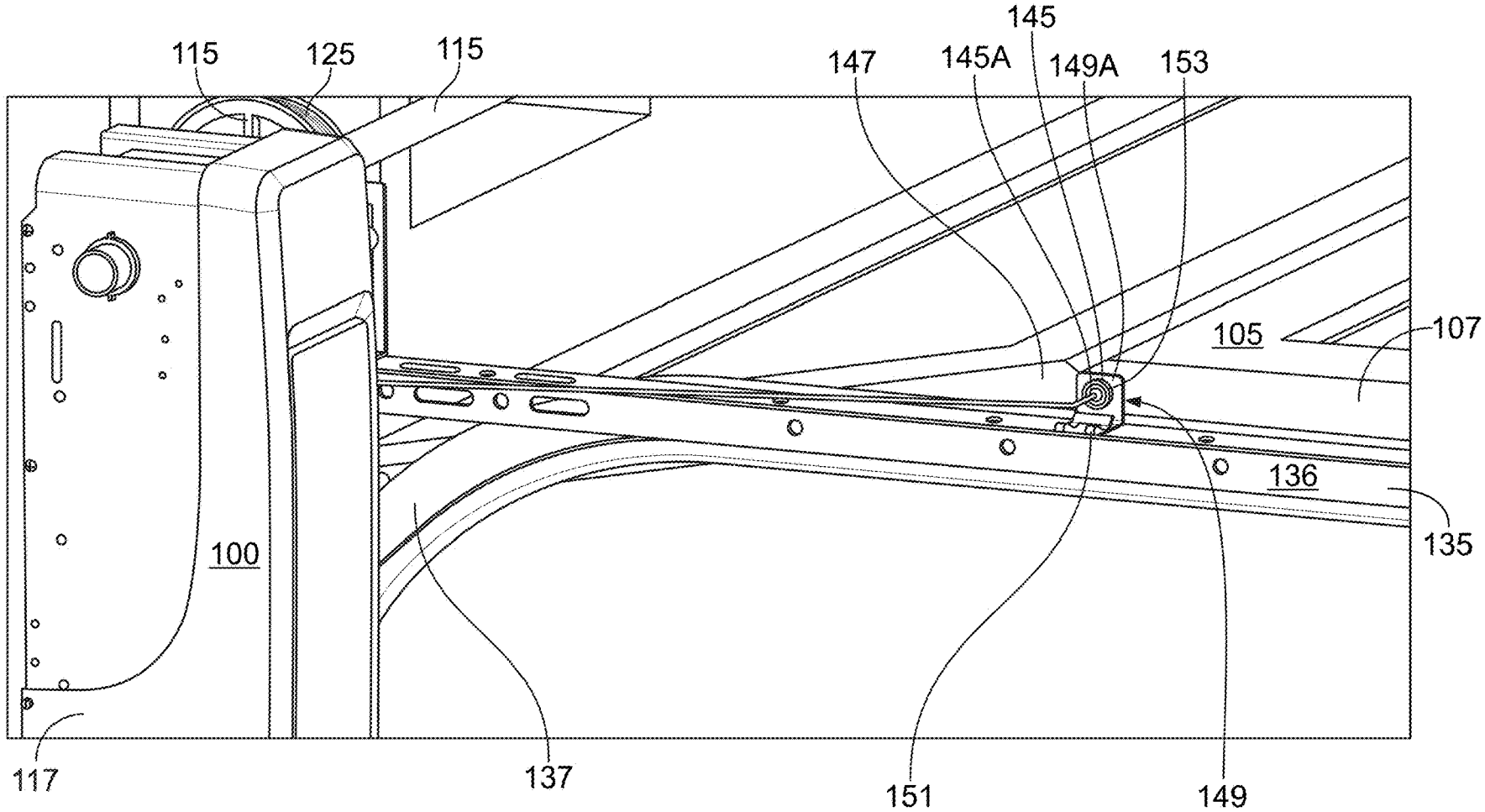
FIG. 2 is a close-up view of a portion of the system of FIG. 1, showing an example door monitoring sensor of the movable barrier operator system.

With reference now to FIG. 2, the movable barrier operator 100 of FIG. 1 is shown in further detail. The movable barrier operator 100 is in communication with a sensor 145. The sensor 145 is shown mounted on the horizontal portion 135 of the track 136, although the sensor 145 could be mounted on a curved transition portion 137 or the vertical portion 140 of the track 136. In another example, the sensor 145 may be mounted to a wall or the garage door as long as the sensor 145 has a view of the motion of the garage door 105. In another example, the sensor 145 is mounted on a wall or a ceiling. In yet another example, the sensor 145 is part of the movable barrier operator, for example, mounted to or integral/unitary with a side of a housing 117 of the movable barrier operator 100. The sensor 145 is configured to directly monitor the movement of the garage door 105. The sensor 145 may be activated when the movable barrier operator 100 receives a command, for example, a close command. In another example, the sensor 145 remains in a substantially active state. The movable barrier operator 100 runs the motor 110 to unwind the cables 125, 130 from the cable drums 115, 120. The sensor 145 may be used to monitor whether the garage door 105 is moving, because the cables 125, 130 can become tangled and/or crisscrossed if the weight of the garage door 105 is not keeping the cables 125, 130 in tension. The sensor 145 may be used to determine the position of the garage door 105, the speed or velocity at which the garage door 105 is moving, the direction the garage door 105 is moving, and/or the acceleration of the garage door 105. The sensor 145 may be a camera, a hall effect sensor, or a series of proximity sensors as examples. The sensor 145 may communicate with the movable barrier operator 100 using wired and/or wireless approaches.

Regarding FIG. 1, the sensor 145 may include a wired or wireless camera 112 situated to capture data such as individual images and/or a series of images (e.g., video) within the garage. The camera 112 may be positioned so that at least a portion of the garage door 105 is within the field of view of the camera 112. The camera 112 may thereby monitor movement of the garage door 105 including during closing of the garage door 105. Data from the camera 112 may be used to determine one or more variables of the garage door 105, such as whether the garage door 105 is moving and/or a speed of the garage door 105.

The camera 112 may be configured to continuously capture data and, if the camera 112 detects an event such as movement of the garage door 105, communicate the captured data to a remote device. Alternatively, the camera 112 captures data in response to a communication from a remote device. For example, the camera 112 may be configured to start capturing data when the movable barrier operator system 10 closes or begins to close the garage door 105. The movable barrier operator 100 may communicate a signal to the camera 112 that causes the camera 112 to start capturing data upon the movable barrier operator 100 receiving a close command. The camera 112 may continue to capture data for a predetermined amount of time after the garage door 105 begins to close. Data captured by the camera 112 can be viewed remotely via a remote device, such as a smartphone.

Figure 3:
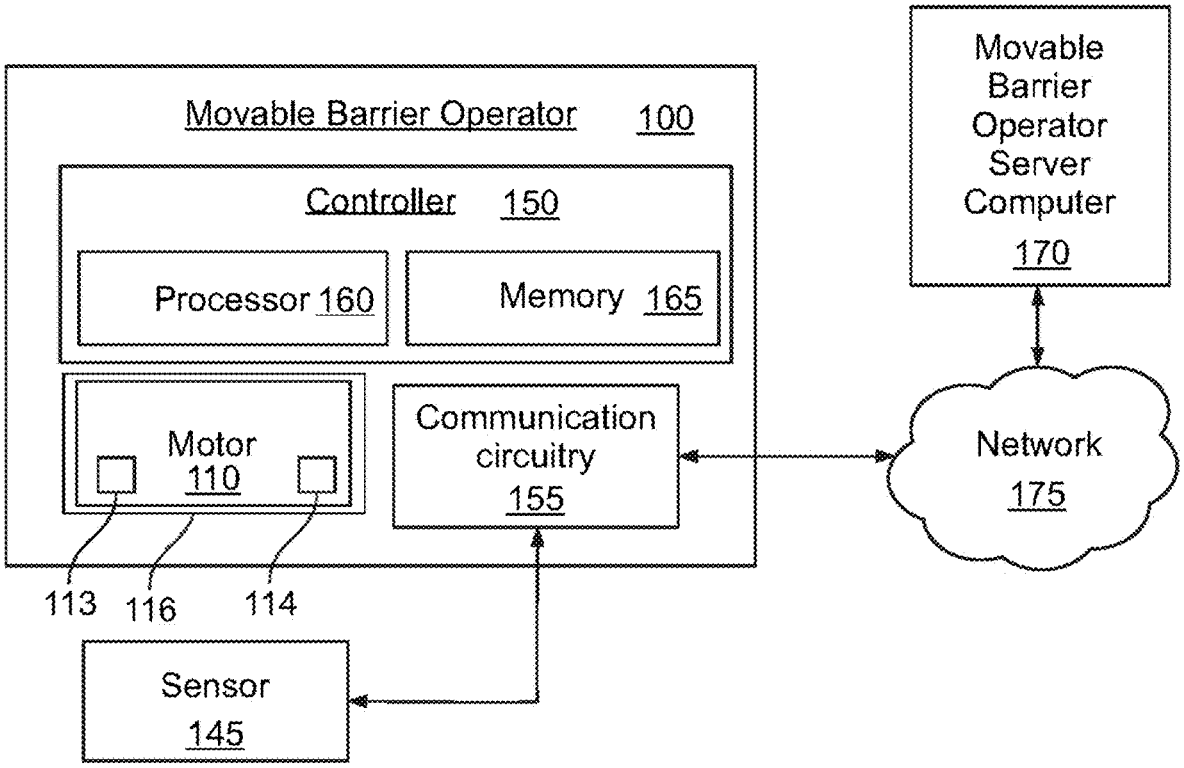
FIG. 3 is an example block diagram of the movable barrier operator of FIG. 1, the movable barrier operator being in communication with the sensor and a movable barrier operator server computer.

With reference now to FIG. 3, the movable barrier operator 100 comprises a controller 150, a motor 110, and communication circuitry 155. The controller 150 includes a processor 160 and a memory 165. The communication circuitry 155 is configured to communicate with the sensor 145. A communication from the communication circuitry 155 may cause the sensor 145 to begin sensing or collecting data regarding the garage door 105 upon the movable barrier operator 100 receiving a state change request. As an example, the movable barrier operator 100 may provide electrical power to the sensor 145 upon the movable barrier operator 100 receiving a state change request to cause the sensor 145 to start detecting one or more variables of the garage door 105. The sensor 145 then communicates data indicative of the one or more sensed variables to the movable barrier operator 100. The communication circuitry 155 is configured to receive the data collected or sensed by the sensor 145 and provide corresponding information to the controller 150. In one embodiment, the controller 150 is configured to process the information collected by the sensor 145. The controller 150 is configured to determine whether the sensed variable is acceptable, such as whether garage door 105 is moving and/or moving at an acceptable speed, based at least in part on the operation of the motor 110 and data from the sensor 145.

In one embodiment, the acceptable speed is a speed having a small difference, such as a percentage or threshold value, from the expected speed. As an example, a measured speed may be an acceptable speed may if there is a difference of less than 5% between the measured speed and the expected speed. As another example, a measured speed may be an acceptable speed if there is a difference of less than one inch per second between the measured speed and the expected speed. The expected speed may be programmed into or predetermined at the controller 150. For example, the controller 150 may store a predetermined speed profile for the garage door 105 that associates a predetermined speed with a position of the garage door 105.

The expected speed of the door may vary depending on the application, use or context/environment. For example, the expected speed for a garage door in a residential application when the garage door initially starts moving from the open position to the closed position may be in the range of approximately five inches per second to approximately seven inches per second. The expected speed for a barrier in a commercial or industrial application when the barrier initially starts moving from the open position to the closed position may be approximately twelve inches per second. Further, the expected speed for a fabric barrier or door as the fabric barrier or door initially starts moving from the open position to the closed position may be approximately twenty-four inches per second.

If the controller 150 determines the sensed variable is not acceptable, such as the garage door 105 is not moving at an acceptable speed, the controller 150 sends a signal to the motor 110 to stop, slow, or reverse operation. The controller 150 may make the determination of whether the garage door 105 is moving at an acceptable speed based on the data from the sensor 145 alone, or based on data from the sensor 145 and data from one or more sensors such as a drive position sensor 113. The drive position sensor 113 may include, for example, a digital encoder and/or an optical detector that detects interruptions of a light beam by rotating transmission component(s). As another example, the drive position sensor 113 may include a sensor that detects a resistance that changes with rotation of one or more components.

In another embodiment, upon receiving information from the sensor 145, the movable barrier operator 100 communicates corresponding data to a movable barrier operator server computer 170 over a network 175 using the communication circuitry 155. The network 175 may include one or more networks, for example, a wireless access point and the internet. The movable barrier operator server computer 170 may process the information from the sensor 145 and determine whether the garage door 105 is moving at an acceptable speed. If the movable barrier operator server computer 170 determines that the garage door 105 is not moving at an acceptable speed, the movable barrier operator server computer 170 may send a message to the movable barrier operator 100 to stop, slow, or reverse operation of the motor 110. The movable barrier operator server computer 170 may store historical data regarding operation of the movable barrier operator 100 and monitor the operation of the movable barrier operator 100 to facilitate maintenance of the movable barrier operator 100. For example, the movable barrier operator server computer 170 may detect a downward trend of the speed of the garage door 105 and/or the speed of the garage door 105 being below a predetermined threshold. In these situations, the movable barrier operator server computer 170 may communicate a message to a user device, such as an SMS message and/or an email, to a user indicating the movable barrier operator 100 may benefit from maintenance. In another embodiment, the movable barrier operator server computer 170 requests service of the movable barrier operator 100 by a maintenance provider and/or places the movable barrier operator 100 in an error state until the movable barrier operator 100 is serviced.

The sensor 145 may include one or more cameras, such as camera 112 of FIG. 1 and/or camera 145A of FIG. 2, that is configured to capture pictures or video including images of a portion of the garage door 105 upon the movable barrier operator 100 initiating operation in response to a state change request, for example, a close command. In one example, the camera 145A takes a series of images at a rate of approximately 2 to approximately 60 frames per second, such as approximately 30 frames per second. The camera 145A sends the image data to the movable barrier operator 100. This communication may be via wired or wireless approaches. For wireless approaches, the camera 145A may communicate using a variety of protocols including, as examples, Wi-Fi, Zigbee, and/or Bluetooth® Low Energy. In one embodiment, the camera 145A is a part of the movable barrier operator 100.

The controller 150 processes the image data from the camera 145A to determine whether the garage door 105 is moving. In one approach, to determine whether the garage door 105 is moving, the movable barrier operator 100 receives and compares a first image frame and a second image frame. A portion 147 of the garage door 105 is detected in the first frame and compared to where the portion 147 of the garage door 105 is in the second frame. In FIG. 2, the portion 147 includes a joint between panels of the garage door 105. In another embodiment, the portion 147 may include a leading edge of the bottom panel of the garage door 105.

The controller 150 analyzes the first and second frames to identify the bottom edge of the garage door 105 and how far the bottom edge has moved from the first frame to the second frame in the time between the first and second frames to determine the speed of the garage door 105. In another example, the portion 147 includes a hinge in between two panels of the garage door 105. The controller 150 identifies the hinge in the first and second frames and compares the position of the hinge in the first and second frames. In yet another example, the portion 147 includes a line, a series of lines, or other indicium on the side of the garage door 105 facing the track 136 that is/are detected by the camera 145A. The markings may be placed on the side of the garage door 105 by an installer using permanent marker or otherwise preconfigured by a manufacturer of the garage door.

In comparing the position of the portion 147 of the garage door 105 between the first and second frames, the distance the portion 147 travels is divided by the time between frames to determine the speed of the garage door 105. The frames analyzed by the controller 150 need not be sequential. For example, the camera 145A may capture 30 frames per second and a first frame and a fifteenth frame may be compared, with the time between the first and the fifteenth frames being 0.5 seconds. The camera 145A has a field of view and is installed so that the portion 147 is within the field of view at a predetermined portion of the range of motion of the garage door 105. For example, a distance within the first foot of door travel, such as the first two inches from the open position toward the closed position, may be the most important in detecting non-movement of the garage door 105. The speed of the garage door 105 during the initial few inches of travel as the garage door 105 moves from the open position toward the closed position should closely match the speed of the cable 125 as the cable 125 is payed out from the drum 115. A divergence in the speed of the garage door 105 from the speed of the cable 125, such as the speed of the garage door 105 being less than one inch per second while the cable 125 is payed out at a speed corresponding to five inches per second of movement of the garage door 105, indicates the garage door 105 is not lowering properly and the cable 125 may be at risk of tangling or coming off of the drum 115.

In this example, the camera 145A is installed so the portion 147 is in the field of view when the garage door is in the open position thereof. Upon the camera 145A being activated, the camera 145A captures the first frame when the garage door 105 is at the open position, and the camera 145A captures the second frame as the garage door 105 moves toward the closed position.

The distance the portion 147 travels may be determined by having the camera 145A installed in a position where the camera 145A is a known distance from the garage door 105, such that a change in position within the field of view of the camera 145A correlates to a known distance. In one approach, the installer measures the distance between the camera 145A and the garage door 105 and provides the distance to the movable barrier operator 100 via, for example, a user interface of the movable barrier operator 100 or an application on the installer's smartphone which communicates the distance by way of a Bluetooth transceiver of the communication circuitry 155. In another approach, the system 10 includes a mount 149 that connects the camera 145A to the track 136. The distance between the track 136 and the garage door 105 may be relatively standardized for different garage doors. Thus, when the camera 145A is connected to the track 136 with the mount 149, the processor 160 can retrieve the standard distance from the memory 165 and use the standard distance for calculations. In one embodiment, the mount 149 includes a body 149A including a base portion 151 that mounts to the track 136 and a riser portion 153 upstanding from the base portion 151. The base portion 151 may mount to the track 136 using a clip, one or more fasteners, and/or an interlocking portion with the track 136. The track 136 and the camera 145A may move and/or vibrate as the garage door 105 travels along the tracks 136. The mount 149 may include one or more portions configured to dampen movement and/or vibration of the camera 145A. For example, the mount 149 may include one or more resilient members, such as an elastomeric pad, configured to dampen movement and/or vibration of the camera 145A. As an example, the mount 149 may include a steel body 149A and an elastomeric pad between the steel body 149A and the track 136. Additionally or alternatively, the processor 160 may perform an image stabilization process on the image data from the camera 145A to compensate for movement and/or vibration of the camera 145A.

As an example, the mount 149 positions the camera 145A so that a change of five pixels in the position of the garage door portion 147 from the first frame to the second frame correlates to a movement of one inch. If the frame rate is 30 frames per second and the portion 147 takes six frames to move the five pixels, the processor 160 determines the garage door 105 is moving at 5 inches per second.

The distance between the camera 145A and the garage door portion 147 may also be learned by the movable barrier operator 100 upon installation. For example, the portion 147 of the garage door 105 may include markings visible in the field of view of the camera 145A that are a known distance apart. The processor 160 determines the distance between the camera 145A and the door 105 based on the distance between the markings in the field of view.

In another embodiment, the sensor 145 may be calibrated using data acquired during initialization of the movable barrier operator 100. For example, when the operator 100 is first installed, the limits of travel of the garage door 105 are set and a full travel of the garage door 105 is completed. During the initialization, the change in position of the garage door 105 detected by the sensor 145 may be utilized to determine the operating speed of the garage door 105 against which subsequent detected speeds will be compared. As a further example, the initialization may involve the movable barrier operator 100 moving the garage door 105 at the normal speed and at a slower speed. The difference in data from the sensor 145 between the normal speed and the slower speed may be utilized subsequently to determine whether the garage door 105 is operating at a slower than normal speed.

The process of comparing image frames may be repeated. While comparing two image frames has been given as an example, it should be understood that a series of image frames may be compared. The frames may be sequential or non-sequential, such as every other frame. For example, for each garage door speed calculation, the determined speed may be an average of the speed calculation using the comparison of three consecutive pairs of image frames. Still further, the speed of the garage door may be tracked over time and an acceleration of the door may be determined.

In another approach, the movable barrier operator 100 determines the position of the garage door 105 rather than the speed at which the garage door 105 is moving. In this example, the movable barrier operator 100 may receive a single image frame and determine whether the garage door 105 has moved away from a fully open position. The portion 147 may include a series of numbers along the side of the garage door 105 panels. For example, a panel may be marked with "1, 2, 3 . . . " along the side of a panel, with each number being separated by a distance of, for example, one inch. When the camera 145A provides a frame to the processor 160, the processor 160 determines which number (e.g. using an optical character recognition (OCR) technique) is visible in the frame. For example, if the "1" marking is in the center of the frame, the processor 160 determines that the movable barrier has not moved. If the "1" marking is at the left portion of the frame and the "2" marking is at the center of the frame, the processor 160 determines that the garage door 105 has moved one inch toward the closed position. Through a series of image frames the speed of the garage door 105 can also be determined. The markings need not be numbers, but rather may be any indicia that may be identified and distinguished from each other using the camera 145A to determine the position of the garage door 105. The markings may be standardized in form and position for use with many different movable barriers. In another example, the relative positions of the markings are learned by the movable barrier operator 100 when the movable barrier system is installed or setup.

The camera 145A may be installed along the track 136 of the garage door 105. This puts the camera 145A in a position so that a side 107 or side edge of the garage door 105 may be viewed. In another example, the camera 145A may be mounted on the ceiling of the garage intermediate horizontal portions 135 of the tracks 136, and the top or bottom edge of the garage door 105 may be viewed. In one example, the camera 145A may be a component of a home security system. Regardless of the installation position of the camera, if the portion 147 of the garage door 105 is within the view of the camera 145A and the camera 145A is operably connected to the movable barrier operator 100 and/or the movable barrier operator server computer 170, the images from the camera 145A can be processed and the position, speed, and/or acceleration of the garage door 105 determined using the above described example image analyzing techniques.

In another embodiment, the sensor 145 is a proximity sensor such as a hall effect sensor or a magnetometer. The portion 147 of the garage door 105 includes a magnet or series of magnets attached to the garage door 105 or within the garage door 105. When the garage door 105 begins to move, the hall effect sensor detects a change in the magnetic field (e.g. strength, vector direction, etc.) and a speed of the garage door 105 can be determined. As another example in this regard, the sensor 145 may generate a magnetic field and detects changes in the magnetic field as a metallic or magnetized component (e.g., a hinge) of the garage door 105 moves relative to the sensor 145.

In another embodiment, the sensor 145 includes one or more time-of-flight sensors. The time-of-flight sensors may utilize light and/or sound to detect the distance between the sensor 145 and one or more objects, such as components of the garage door 105. As one example, the sensor 145 may be mounted to the bottom edge of the garage door 105 and detects the distance between the bottom edge of the garage door 105 and a floor of the garage. As another example, the sensor 145 may be mounted to the floor and detects the distance between the floor and the bottom edge of the garage door 105. In another embodiment, the sensor 145 is configured to detect the distance between the sensor 145 and the cable 125 on the drum 115. The distance between the sensor 145 and the cable 125 on the drum 115 may be used to determine the position of the garage door 105. It will be appreciated that the sensor 145 may include one or more of the same type or different types of sensors in order to facilitate an accurate determination of the actual behavior of the garage door 105.

In yet another embodiment, the sensor 145 includes a series of proximity sensors such as contact closure sensors. In this embodiment, the contact closure sensors are placed along the portion of the track 136 just below the bottom edge of the garage door 105 when the garage door 105 is in a fully open position. In an example embodiment, there are two contact closure sensors. When the garage door 105 is in a completely open position, the contact closure sensors do not detect the garage door 105 in proximity to either of the sensors. When the garage door 105 begins to move toward the closed position, a bottom roller of the garage door 105 comes into range of the first contact closure sensor and the sensor 145 sends a signal to the movable barrier operator 100. The processor 160 utilizes the signal to identify that the garage door 105 has moved at least as far as the first contact closure sensor. As the garage door 105 continues to move, the bottom roller of the garage door 105 moves near the second contact closure sensor. The second contact closure sensor sends a signal to the movable barrier operator 100. The processor 160 determines approximately how much time it takes the garage door 105 to move, after the motor 110 starts operating, from the fully open position to the first contact closure sensor. The processor 160 also determines the time it takes for the garage door 105 to move from the first contact closure sensor to the second contact closure sensor. If the distances between the fully open position of the garage door 105, the first contact closure sensor, and the second contact closure sensor are known, a position, speed, and/or acceleration of the garage door 105 may be determined. In other embodiments, a greater number of contact closure sensors may be used, for example, five contact closure sensors.

As another example, the sensor 145 may include an emitter that emits an electromagnetic signal, such as infrared light, toward the garage door 105 and a detector that detects all or a portion of the electromagnetic signal reflected back from the garage door. As an example, the portion 147 of the garage door 105 may include one or more reflectors affixed to the side 107 of the garage door 105.

Figure 4:
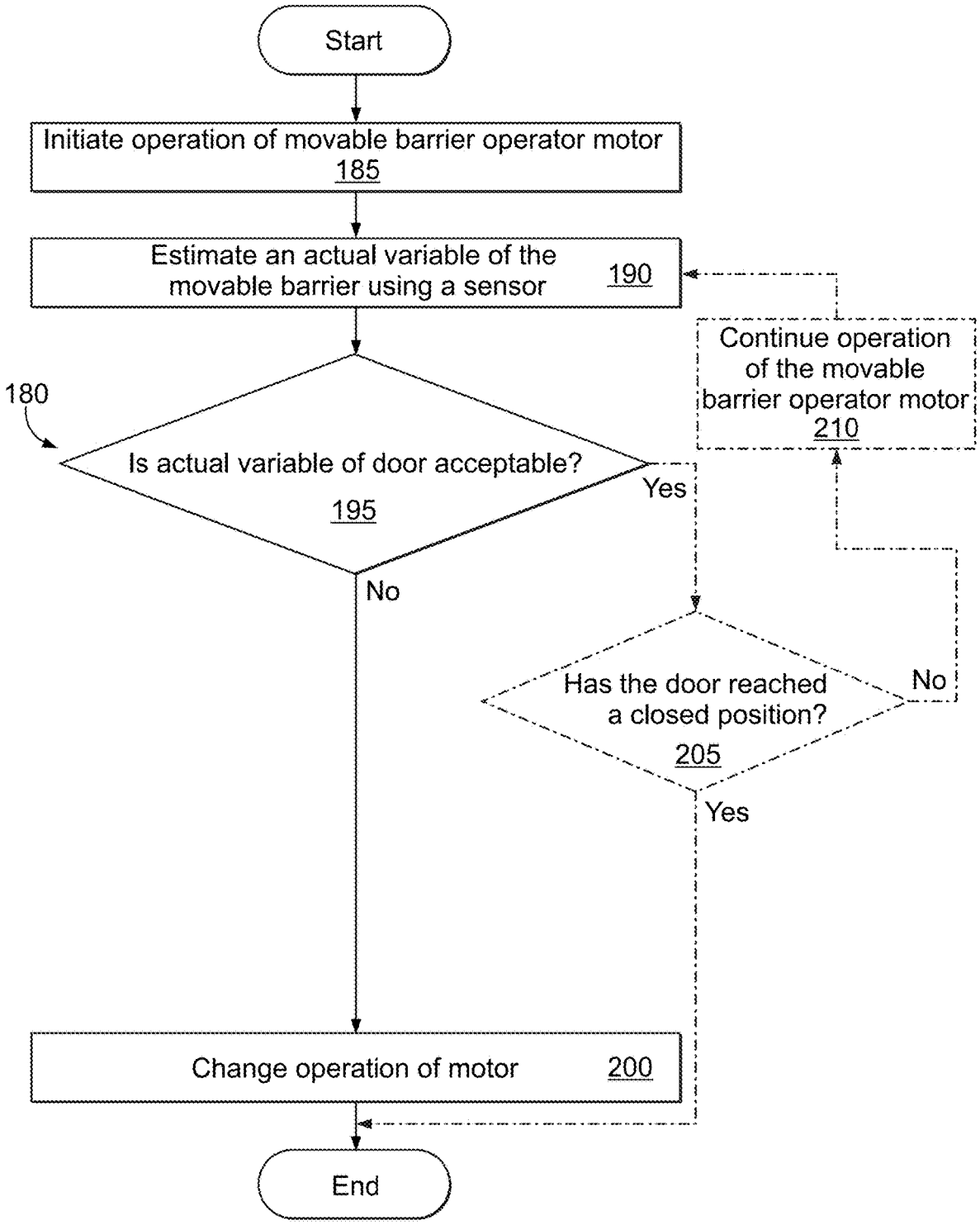
FIG. 4 is a flow chart of an example method that includes using the sensor of FIG. 2 to monitor and control the motion of a movable barrier.

With reference now to FIG. 4, a method 180 is provided for monitoring a movable barrier, such as the garage door 105. One or more of the operations of the method 180 may be performed by the movable barrier operator 100 and/or the movable barrier operator server computer 170. The method includes initiating 185 the operation of the movable barrier operator motor 110. This may be in response to the communication circuitry 155 receiving a state change request, such as a close command, from a transmitter, a keypad, a wall controller, or a user device such as a smartphone, as examples.

Concurrent with or after initiation of the motor 110, an actual variable of the garage door 105 is estimated 190 using the sensor 145. The actual variable may include one or more variables, such as the position, speed, and/or acceleration of the garage door 105. The actual variable is estimated 190 by directly sensing the garage door 105 via the sensor 145.

The sensor 145 may include one or more sensors 145, for example a camera 145A and a series of proximity sensors. The sensors 145 may be used in combination or separately to provide redundancy. The speed of the movable barrier may be determined in accordance with above disclosures, for example, determining how many pixels the portion 147 of the garage door 105 has moved in between two image frames and the time between the frames.

Next, the method 180 includes determining 195 whether the variable of the garage door 105 is acceptable based at least in part on the operation of the movable barrier operator motor and an expected variable of the garage door 105. For example, the movable barrier operator 100 and/or the movable barrier operator server computer 170 may have a non-transitory computer readable storage (e.g., memory 165) that contains an expected variable including an expected speed profile for the garage door 105. The speed profile may include the expected speed of the door at a given position of the garage door 105 and/or the expected speed of the garage door 105 at time intervals measured from the initiation of the motor 110, as some examples. The determining 195 includes determining whether the current speed of the garage door 105 is within, for example, a range of 95 percent to 105 percent of the expected speed at a given time.

The expected speed may be a set speed for multiple movable barrier operators 100 or may be unique for a particular movable barrier operator 100. For example, an installer may provide installation details (e.g., the shape and/or dimensions of the drum 115) to the movable barrier operator 100 and the processor 160 selects the expected speed from a database stored in the memory 165. As another example, the communication circuitry 155 includes an RFID reader that retrieves identifying information from an RFID tag of the drum 115. The processor 160 may then determine the expected speed of the garage door 105 based on the retrieved identifying information, which may include or be representative of the geometry of the drum 115.

The motor 110 may be controlled to run at a slower speed initially to allow the movable barrier to gain speed. Then the motor 110 may increase to a constant rate of speed. For example, before the initiation of the motor 110, it is expected that the movable barrier is stationary. Just after initiation of operation of the motor 110, for example, at 0.5 seconds after initiation, it may be expected that the garage door 105 is moving at a speed of three inches per second. After one second, it is expected that the garage door 105 is moving at a rate of seven inches per second. These speeds are provided as examples and are not intended to be limiting.

Based on a given time and/or position of the garage door 105, the operation 195 involves determining whether the actual variable (e.g. door speed) calculated using data from the sensor 145 is acceptable based at least in part on an expected variable. Different criteria may be used at operation 195. For example, operation 195 may involve determining whether the current speed of the garage door 105 is within an acceptable range of the expected speed. In the example above, for the time 0.5 seconds after initiation where the expected speed was three inches per second, an acceptable range may be 2.5 to 3.5 inches per second. At one second after initiation 185, the acceptable range may be 6.8 to 7.2 inches per second. The acceptable range of speed may vary based on the system, the position of the movable barrier, the time that has passed since initiation 185 of operation of the motor 110, etc. The acceptable speed range may be learned by the movable barrier operator 100 at installation or may be programmed into the memory 165 at the factory. The acceptable speed range may be adjusted by the installer. The acceptable range may be a plus or minus percentage of the expected speed, as an example.

The operation 195 may utilize other criteria to determine whether the variable is acceptable. For example, the operation 195 may involve comparing the current speed and/or position of the garage door portion 147 to one or more thresholds. The variable (e.g. speed) may be acceptable if the variable is above or beyond the threshold. As another example, the actual variable of the garage door 105 estimated using the sensor 145 may include the direction of movement of the garage door 105 and the expected variable is the expected direction of movement of the garage door 105. If the detected and the expected directions are the same, the operation 105 may determine the actual variable of the garage door 105 to be acceptable.

If the variable of the garage door 105 is determined 195 to not be acceptable, operation 200 involves changing e.g., stopping, slowing, and/or reversing operation of the motor 110. In some embodiments, the operation 200 may involve increasing the speed of the motor. The operation 200 may be utilized to synchronize the expected and actual behavior of the garage door 105.

In one example, upon the processor 160 determining that the speed of the movable barrier is not within an acceptable range, the motor 110 reverses operation until the sensor 145 detects that the garage door 105 has returned to the completely open position. The movable barrier operator 100 may then attempt to move the garage door 105 to the closed position again. Alternatively, the movable barrier operator 100 enters an error state and signals the error to the user. This signaling of an error state may be by way of an indicator such as a light or a display on the movable barrier operator 100, for example, a red light. The movable barrier operator 100 may notify the movable barrier operator server computer 170 of the error. The movable barrier operator 100 may also cause a notification (e.g. SMS text or email) to be sent to a user's account or smartphone alerting them of the error in operation of the movable barrier operator 100. The user may then be prompted to service the movable barrier operator 100.

In another example, upon determining 195 that the variable of the garage door 105 is not acceptable, the processor 160 slows the operator of the motor 110 to cause the drums 115 to pay out the cables 125, 130 more slowly. In some embodiments, the motor 110 may slow down to a speed that corresponds to the speed the garage door 105 has been determined to be moving. In another embodiment, upon determining the garage door 105 is not moving at an acceptable speed, the motor 110 is stopped. After a period of time, the motor 110 begins operation again and the speed of the garage door 105 is once again monitored. This may be done to give the garage door 105 the opportunity to be drawn down, by the force of gravity, to remove slack from the cables 125, 130. After beginning the operation of the motor 110 again, if the garage door 105 is still not moving at an acceptable rate, the operations 185, 190, 195 may be repeated, or the motor 110 may reverse operation as described above.

In one embodiment, the garage door 105 is only tracked for a few inches or the first foot of the movement of the garage door 105. After a section of the garage door 105 has moved to the vertical portion 140 of the tracks 136 from the horizontal portion 135, the weight of the garage door 105 in the vertical portion 140 will pull the rest of the garage door 105 toward the closed position, keeping sufficient tension on the cables 125, 130. The sensor 145 may only detect movement of the garage door 105 from the open position to a position wherein one or two sections of the garage door 105 have entered the vertical portion 140.

Optionally, the entire travel of the garage door 105 may be tracked and monitored. If the variable of the garage door 105 is determined in operation 195 to be acceptable, the method 180 includes determining 205 whether the garage door 105 has reached a closed position. If the garage door 105 has reached a closed position and the speed of the door is zero inches per second, the method 180 is complete. However, if the garage door 105 has not reached a closed position, the movable barrier operator 100 continues 210 the operation of the motor 110. The variable of the garage door 105 is once again estimated 190 using the sensor 145 and it is determined 195 whether the variable is acceptable. If the variable is not acceptable, the movable barrier operator 100 stops or reverses operation as previously described. If the garage door 105 has reached a closed position, the method ends. If not, the method loops again and continuously monitors the variable of the garage door 105 until the garage door 105 reaches a closed position.

This optional continuous monitoring of the garage door 105 may be performed to ensure the garage door 105 reaches a closed position without error. Situations arise where the garage door 105 begins to move towards the closed position, but before reaching the closed position, the garage door 105 stops. For example, the garage door 105 encounters an object and stops. If this portion of the motion were not monitored, the motor 110 may continue to unwind the cables 125, 130, but because there is a lack of tension on the cables 125, 130, the cables 125, 130 may become tangled or crisscrossed on the cable drums 115, 120. While the movable barrier system 10 may include an obstacle detector (such as a photo eye sensor), it is conceivable that an object blocks the path of the garage door 105 and is not detected by the obstacle detector. An example may be when a vehicle is only partially inside the garage and the movable barrier operator 100 receives a command to close the garage door 105. The garage door 105 begins closing but stops when the garage door 105 comes into contact with the portion (e.g. bumper) of the vehicle. The sensor 145 detects, for example, the speed of the garage door 105 going to zero and the processor 160 determines that the speed of the garage door 105 is not acceptable. The processor 160 may then reverse 200 operation of the motor 110.

Figure 5:
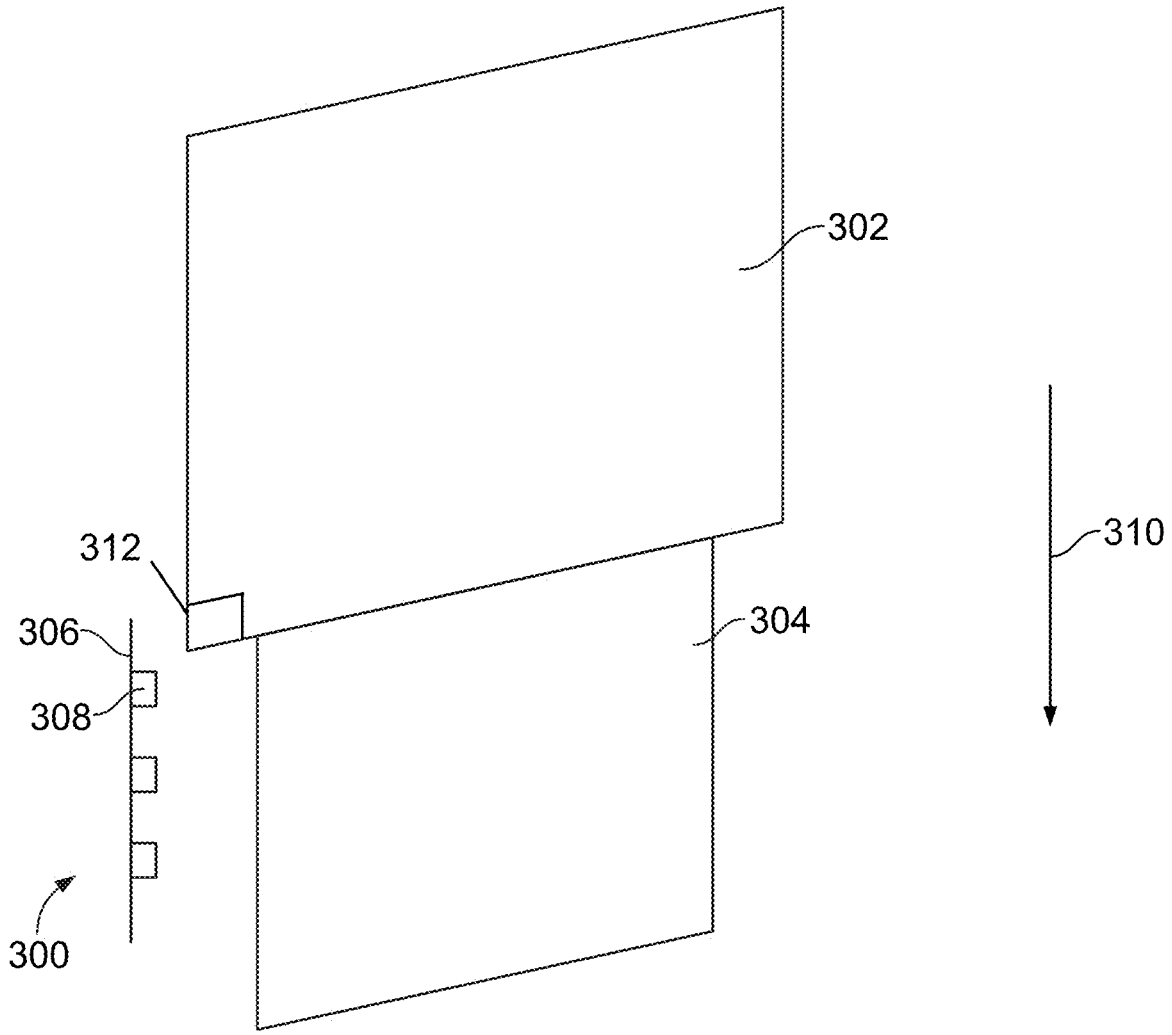
FIG. 5 is a schematic representation of a monitoring sensor that may be used during installation of a movable barrier.

With reference to FIG. 5, the sensor 145 may take the form of an installation sensor 300 that is used to install a movable barrier operator and an associated door 302 that closes an opening 304. The installation sensor 300 includes a support 306 that is connected to a track associated with the door 302 or otherwise supported in position near the door 302. The installation sensor 300 includes sensors 308, such as cameras, proximity sensors, light curtains, or time-of-flight sensors (discussed in greater detail below), that are mounted to the support 306. As the door 302 travels in direction 310 from an open position to a closed position, the sensors 308 may be used to directly detect one or more variables of the door 302 in accordance with the techniques discussed above. The installation sensor 300 may be used during installation to determine whether the door 302 is properly installed, for example, by determining whether the door 302 has an acceptable speed upon closing of the door 302. The installation sensor 300 may be a detachable installation sensor that may be removed upon installation of the door 302. Alternatively, the installation sensor 300 may be fixed to or integrated with the environment adjacent the door 302; for example, when the installation sensor 300 includes a light curtain.

Figure 6:
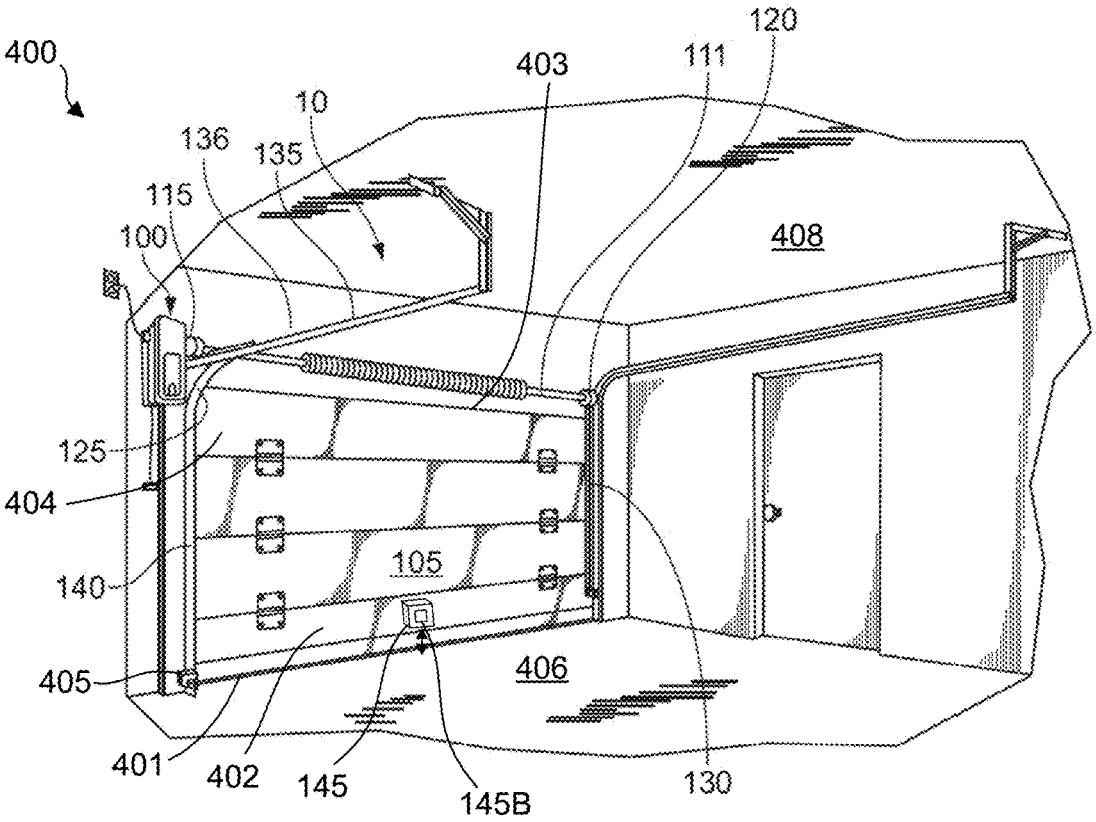
FIG. 6 is a perspective view of an example movable barrier operator system including a time-of-flight sensor and a movable barrier in a closed position.
Figure 7:
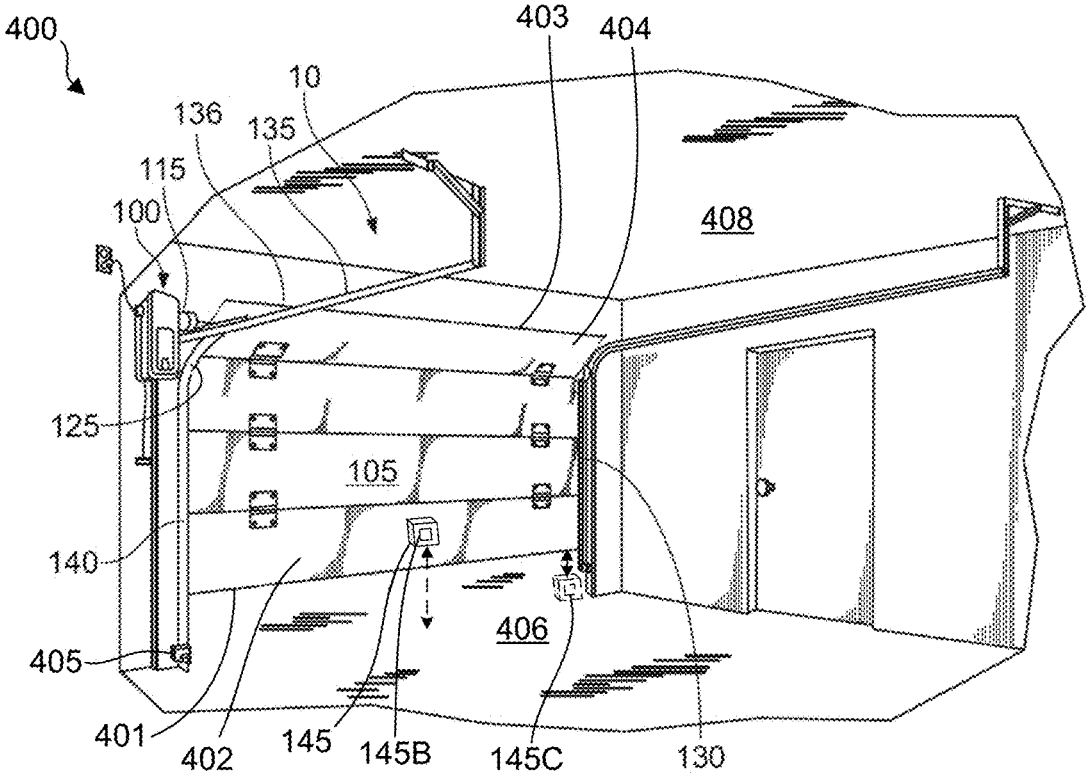
FIG. 7 is a perspective view of the movable barrier operator system of FIG. 6 with the movable barrier in a partially open position.

With reference now to FIGS. 6 and 7, a movable barrier operator system 400 is provided that is similar to the movable barrier operator system 10 discussed above. Due to the similarities, like reference numerals in FIGS. 1, 6, and 7 are used to refer to similar components. The movable barrier operator system 400 comprises a sensor 145, which in one embodiment includes a time-of-flight sensor 145B.

The time-of-flight sensor 145B is configured to emit a signal and measure a time of flight of the signal. For example, the time-of-flight sensor 145B is configured to output a signal and receive at least a portion of the signal reflected from a surface or an object. As discussed in greater detail below, the time-of-flight sensor 145B may be used during initial commissioning or calibration of the movable barrier operator system 400 to provide a desired speed of the door 105 throughout the range of motion of the door 105. In one embodiment, the time-of-flight sensor 145B may be removed after an initial calibration of the movable barrier operator system 400. In another embodiment, the time-of-flight sensor 145B remains in place after the initial calibration to monitor and maintain a desired speed profile of the door 105.

The time-of-flight sensor 145B may be mounted to the door 105 such that the time-of-flight sensor 145B moves with the door 105. For example, in the embodiment of FIG. 6, the time-of-flight sensor 145B is mounted to the door 105 proximate a bottom edge 401 of a bottom panel 402 of the door 105 such that the time-of-flight sensor 145B moves with the door 105. The time-of-flight sensor 145B is oriented such that the emitted signal is directed toward a surface, such as a garage floor 406. As another example, the time-of-flight sensor 145B may be directed at a surface of the tracks 136. In still another example, the time-of-flight sensor 145B is mounted to the door 105 proximate an upper edge 403 of the top panel 404 of the door 105. In this example, the time-of-flight sensor 145B may be oriented such that the emitted signal is directed toward a wall or ceiling surface 408 of the garage.

In another embodiment, the time-of-flight sensor 145B may be mounted to a stationary surface such that the time-of-flight sensor 145B is not moved during movement of the door 105. In such approaches, the time-of-flight sensor 145B may be oriented such that the emitted signal is directed at a portion of the door 105. For example, as shown in FIG. 7, a time-of-flight sensor 145C may be secured to the garage floor 406 and oriented such that the emitted signal is directed at the bottom edge 401 of the bottom panel 402 of the door 105; for example, when the bottom panel 402 is in a generally vertical orientation along vertical portions 140 of the tracks 136. In another example, the time-of-flight sensor 145C is secured to a wall or ceiling surface 408 of the garage and oriented such that the signal is directed at the upper edge 403 of the top panel 404 of the door 105; for example, when the top panel 404 is in a generally horizontal orientation along horizontal portions 135 of the tracks 136. In another embodiment, the time-of-flight sensor 145C is secured to a portion of the tracks 136 and is oriented such that the signal is directed at a portion of the door 105. For example, the time-of-flight sensor 145C may be secured to a vertical portion 140 of the track 136 and oriented such that the signal is directed at the bottom edge 401 of the bottom panel 402. In another example, the time-of-flight sensor 145C is secured to a horizontal portion 135 of the track 136 and oriented such that the signal is directed at the upper edge 403 of the top panel 404 of the door 105.

The movable barrier operator 100 may be in the form of a jackshaft-style operator. As described with respect to FIG. 3, the movable barrier operator 100 may include a motor 110, a controller 150 that includes a processor 160 and a memory 165, and a communication circuitry 155 that is configured to communicate with the sensor 145.

The motor 110 may be a component of a variable speed drive 116 of the movable barrier operator 100. The variable speed drive 116 may permit changing of the speed of the motor 110 such as by changing the frequency of electrical power utilized by the motor 110. For example, the frequency may be adjusted within the range of approximately 30 hertz to approximately 120 hertz.

The variable speed drive 116 may include, or may be connected to, a rotatable member 114 such as an output shaft (see FIG. 3). The rotatable member 114 is configured to be connected to door 105 such that turning of the rotatable member 114 moves the door 105 between an open position and a closed position, including intermediate positions therebetween (see e.g., FIG. 7).

The rotatable member 114 is configured to rotate one or more drums, such as drums 115, 120. The drums 115, 120 include a windup surface about which an elongate member (e.g., cables 125, 130) is wound up on or payed out from to cause corresponding movement of the door 105.

Figure 8:
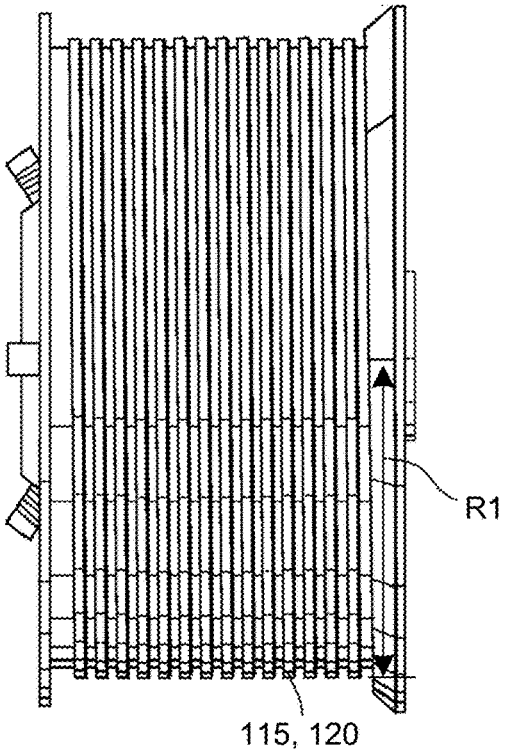
FIG. 8 is an elevational view of a first example drum that may be used in conjunction with the movable barrier operator system.

In the embodiment of FIG. 8, the drums 115, 120 are substantially cylindrical in shape and have a generally constant radius body R1 configured to maintain a generally constant moment arm and speed of the door 105 throughout the range of motion of the door 105.

Figure 9:
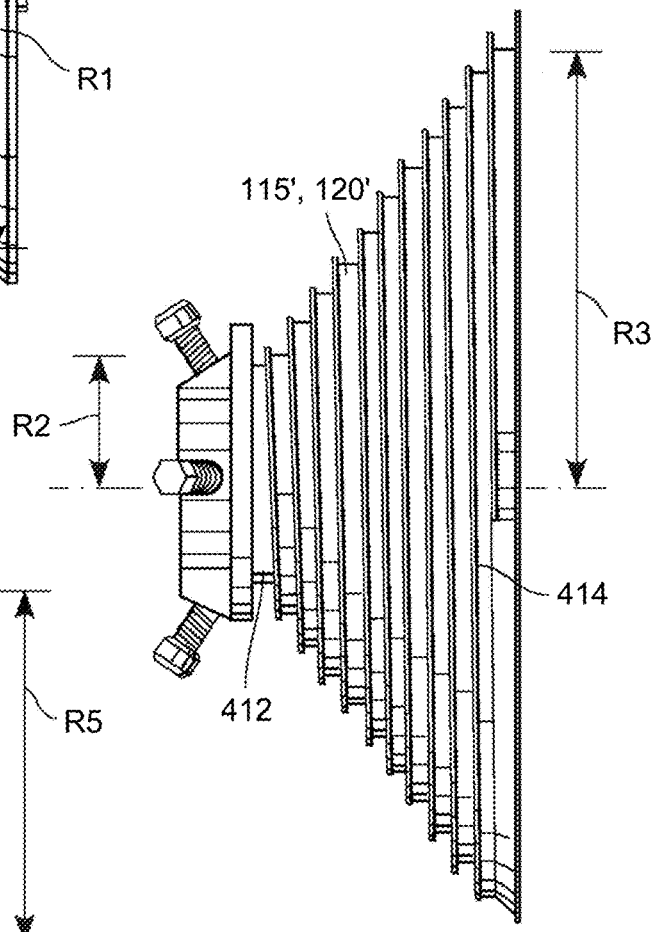
FIG. 9 is an elevational view of a second example drum that may be used in conjunction with the movable barrier operator system.

In another embodiment, the movable barrier operator 100 may be connected to drums 115', 120' having a configuration as shown in FIG. 9. An end of an elongate member (e.g., cables 125, 130) is connected to a startup portion 412 of the drum 115', 120' having a relatively small radius R2, which reduces the moment arm imparted to the drum 115', 120' by the weight of the door 105. The relatively small radius R2 of the drum startup portion 412 and associated smaller moment arm facilitate movement of the door 105 from the closed position where the door 105 is vertical and most difficult to lift. The outer surface of the drum 115', 120' gradually increases in a substantially conical shape until reaching a lock out portion 414 having a relatively large radius R3 configured to inhibit drift of the door 105 away from the open position.

Figure 10:
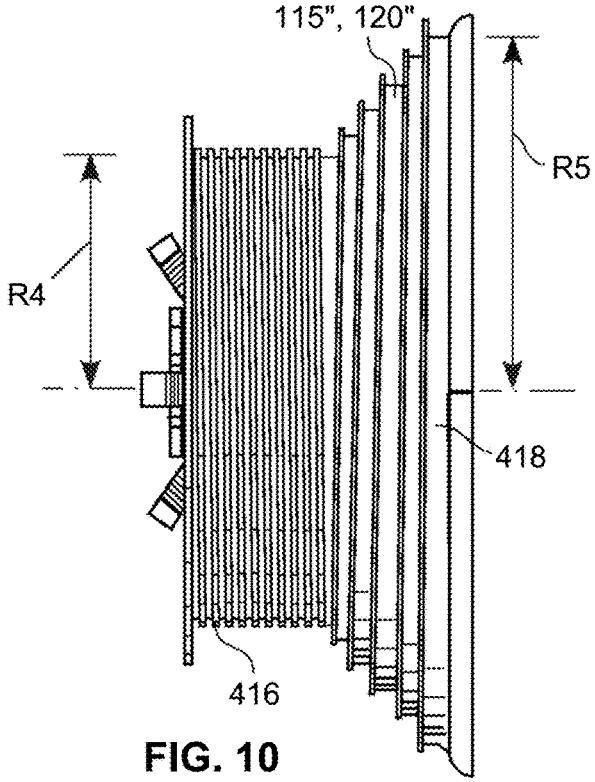
FIG. 10 is an elevational view of a third example drum that may be used in conjunction with the movable barrier operator system.

Similarly, as illustrated in FIG. 10, a drum 115", 120" may be used having a cylindrical start up portion 416 with a generally constant radius R4 and resulting generally constant moment arm throughout a majority of the travel of the door 105. The drum 115", 120" also has a generally conical (or frustoconical) shape extending from the cylindrical portion 416 and terminating in a lock out portion 418 with a relatively larger radius R5 which, like the lock out portion 414, inhibits drift of the door 105 away from the open position.

Referring again to FIGS. 3 and 6, the memory 165 is configured to store a target variable of the door 105. The target variable may include, for example, at least one of a target position and a target speed of the door 105. The target variable may be programmed, for example, by a manufacturer of the movable barrier operator 100. The target variable may also, or may instead, be programmed (or reprogrammed) by an installer or service technician of the movable barrier operator 100.

The memory 165 is further configured to store a pre-calibration speed of the rotatable member 114, as rotated by the motor 110, that corresponds to the target variable. As used herein, a pre-calibration speed may refer to an initial speed that has not been calibrated (e.g., as initially programmed by a manufacturer of the movable barrier operator 100), or may refer to a previously-calibrated speed that was calibrated after initial operation and is to be recalibrated.

Figure 11:
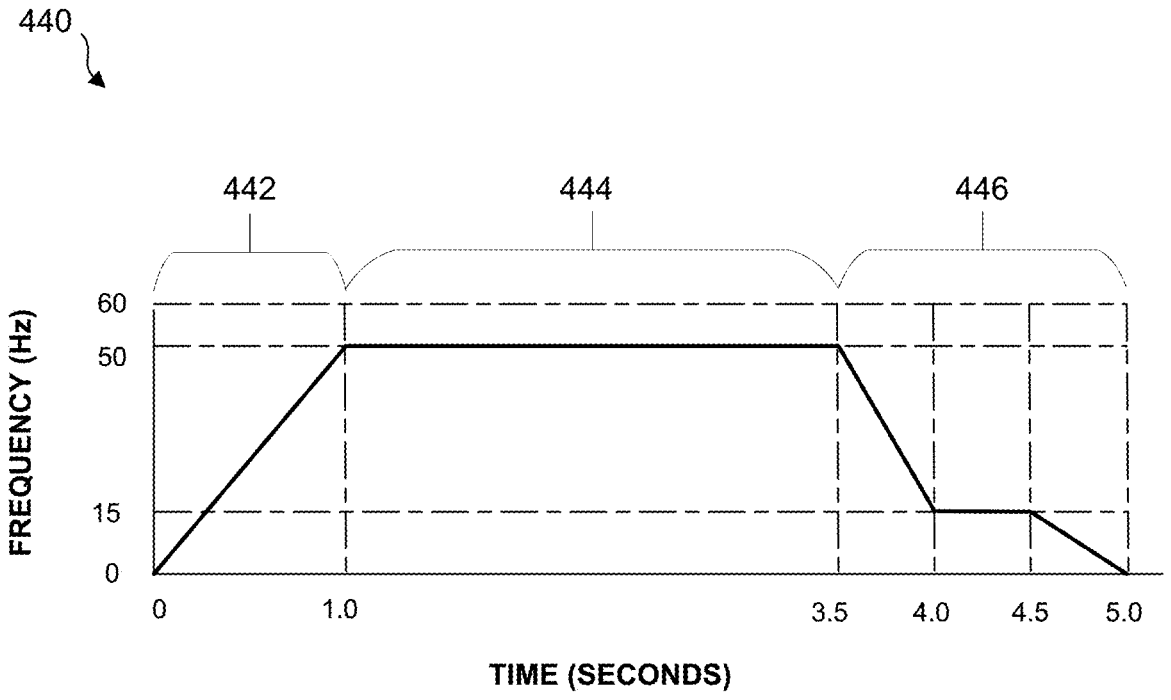
FIG. 11 is a frequency timing diagram of an example movable barrier opening profile for the movable barrier operator system.

Referring to FIG. 11, in one embodiment, the memory 165 is configured to store a plurality of target variables, and a plurality of pre-calibration speeds that correspond to respective target variables. In the example frequency timing diagram of FIG. 11, the variable speed drive 116 may operate the motor 110 according to a closing frequency profile 440 that includes a ramp-up profile 442 during initial movement of the door 105 from the open position, a steady-state profile 444 during intermediate movement of the door 105, and a ramp-down profile 446 during final movement of the door 105 (i.e., as the door 105 approaches the closed position). As discussed in greater detail below, the multiple target variables and corresponding pre-calibration speeds (as effected by the frequency of the variable speed drive 116) may be calibrated and stored in the memory 165. The target variables and/or the pre-calibration speeds may be stored in the memory 165, for example, at the time of installation and/or servicing of the movable barrier operator 100.

The processor 160, which may be a processor circuit, is operably coupled to the time-of-flight sensor 145B, the motor 110, and the memory 165. The processor 160 is configured to cause the motor 110 to turn the rotatable member 114 at a pre-calibration speed that corresponds to the target variable. As discussed, a pre-calibration speed may refer to an initial speed that has not been calibrated (e.g., as initially programmed by a manufacturer of the movable barrier operator 100), or may refer to a previously-calibrated speed that is to be recalibrated.

The processor 160 is further configured to determine an actual variable of the door 105 based at least in part upon a signal received from the time-of-flight sensor 145B. The signal from the time-of-flight sensor 145B carries information regarding time-of-flight measurement(s). The actual variable of the door 105 may include at least one of an actual position, actual speed, actual velocity, an actual acceleration, and actual direction of the door 105. For example, the processor 160 may be configured to use time-of-flight information output from the time-of-flight sensor 145B to determine a distance between the time-of-flight sensor 145B and the door 105 or a stationary surface (e.g., floor 406). In this way, the processor 160 may be configured to use time-of-flight information from the time-of-flight sensor 145B to determine a distance of the door 105 from at least one of the open position and the closed position of the door 105. In other examples, the processor 160 may be configured to use time-of-flight information from the time-of-flight sensor 145B to determine an actual position, speed, velocity, acceleration, and/or direction of the door 105.

The processor 160 is configured to cause the variable speed drive 116 to adjust a rotational speed of the rotatable member 114. More particularly, the processor 160 is configured to cause the variable speed drive 116 to adjust the pre-calibration rotational speed of the rotatable member 114 in response to a difference between the target variable and the actual variable of the door 105. For example, the processor 160 may be configured to cause the variable speed drive 116 to increase the pre-calibration rotational speed of the rotatable member 114 in response to the actual variable (e.g., actual position) being less than (e.g., not achieving) the target variable (e.g., target position). This may occur when the door 105 is not moving at a sufficient speed at a particular location or along a particular path segment. Such insufficient speed may occur, for example, due to increased friction in the tracks 136 of the garage door 105, or due to a particular size and/or shape of the drums and/or sprockets of the movable barrier operator system 400 that was not foreseen by the manufacturer of the movable barrier operator 100. The processor 160 may further be configured to cause the variable speed drive 116 to decrease the pre-calibration rotational speed of the rotatable member 114 in response to the actual variable exceeding the target variable. This may occur when the door 105 is moving at an excessive speed at a particular location or along a particular path segment. Such excessive speed may occur, for example, due to decreased friction in the tracks 136 of the garage door 105 (e.g., due to cleaning or maintenance of the tracks 136), or due a particular size and/or shape of the drum and/or sprocket of the movable barrier operator system 400 that was not foreseen by the manufacturer of the movable barrier operator 100.

The processor 160 may adjust the rotational speed of the rotatable member 114 (e.g., via the variable speed drive 116)

during movement of the door 105. Additionally or alternatively, the processor 160 may adjust the rotational speed of the rotatable member 114 after movement of the door 105 and prior to subsequent operation of the movable barrier operator 100. In one aspect, the processor 160 is configured to change the pre-calibration speed stored in the memory 165 based at least in part upon the processor 160 causing the variable speed drive 116 to adjust the rotational speed of the rotatable member 114. As such, during subsequent operation of the movable barrier operator system 400, the door 105 is operated according to the desired opening and/or closing speeds.

As discussed, the memory 165 may be configured to store a plurality of target variables, and a plurality of pre-calibration speeds that correspond to respective target variables. In one aspect, the processor 160 is configured to determine a plurality of actual variables of the door 105 at different positions of the door 105. The processor 160 is further configured to cause the variable speed drive 116 to adjust the rotational speed of the rotatable member 114 when one or more of the actual variables differ from corresponding target variables.

In one aspect, the processor 160 is further configured to effect an error condition annunciation to a user when the actual variable is not substantially similar to the target variable. The error condition annunciation may be performed at the movable barrier operator 100. As such, the movable barrier operator 100 may include a user interface constituted by one or more speakers, lights, or display screens, or any combination thereof, to provide a user with visual and/or audible feedback. Additionally or alternatively, the error condition annunciation is performed at a device (e.g., smartphone or wall control unit) that is in wired or wireless communication with the movable barrier operator 100, for example, through the network 175 of FIG. 3.

In one embodiment, the processor 160 is further configured to deactivate an auxiliary device 405 in response to determining the door 105 is in the closed position. The auxiliary device 405 may be, for example, one or more optical sensors (e.g., infrared (IR) or photo-eye sensors) for determining whether an object is located in the path of the door 105, a passive infrared detector, a magnetic detector, a capacitance detector, a sound detector, a camera, a light, or a combination thereof.

Figure 12:
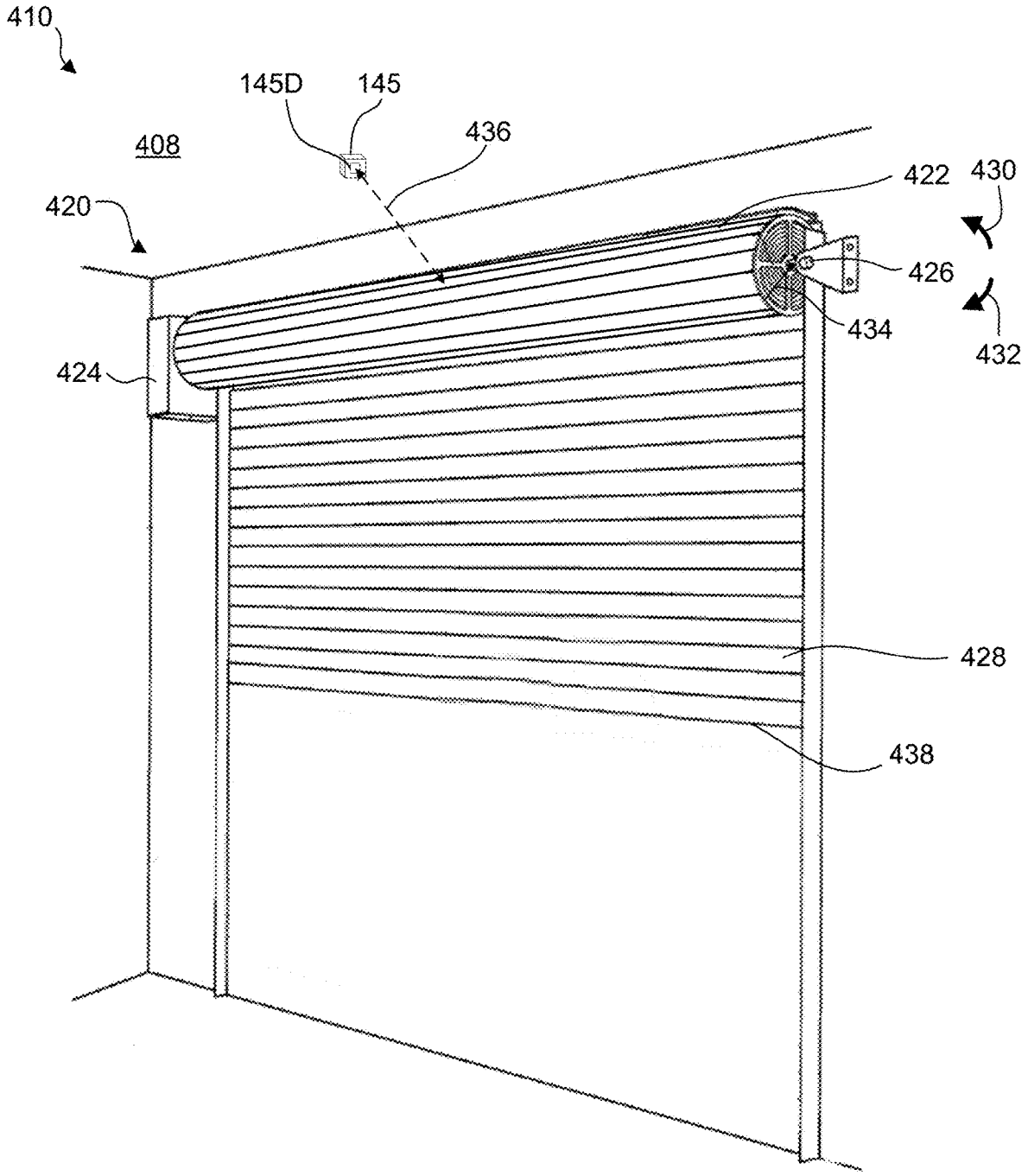
FIG. 12 is a perspective view of a portion of a time-of-flight sensor and directed at a coiled portion of a roll-up movable barrier.

In still another example, and referring to FIG. 12, a movable barrier operator system 410 is provided that is similar in many respects to the movable barrier operator systems 10, 400 discussed above. The movable barrier operator system 410 has a movable barrier 420 including door 428 that includes a coiled portion 422 wound around a shaft 426 of the movable barrier 420. The movable barrier operator system 410 includes a movable barrier operator 424 that is operatively connected to the shaft 426 such that as the movable barrier operator 424 rotates the shaft 426 in a first direction 430 (e.g., an opening direction), the door 428 is wound up on the shaft 426. Conversely, the coiled portion 422 of the door 428 is payed out from the shaft 426 as the shaft 426 rotates in a direction 432 (e.g., a closing direction). The coiled portion 422 may have radius 434 that extends from a central axis of the shaft 426 to an outermost surface of the coiled portion 422. A thickness or diameter of the coiled portion 422 varies relative to a generally spiral winding up and paying out of the door 428 such that the coiled portion 422 has a first radius when the door 428 is in the closed position, and a second radius that is greater than the first radius when the door 428 is in the open position. As such, the coiled portion 422 may decrease in radius as the movable barrier operator 424 rotates the shaft 426 in a closing direction (e.g., direction 432), and may increase in radius as the movable barrier operator 424 rotates the shaft 426 in an opening direction (e.g., direction 430). In this example, a sensor 145 including a time-of-flight sensor 145D (which may correspond to time-of-flight sensors 145B or 145C previously discussed) may be secured to a wall or ceiling surface 408 of the garage and oriented such that the time-of-flight signal emitted from the time-of-flight sensor 145D is directed at the coiled portion 422 of the roll-up movable barrier 420. The time-of-flight sensor 145D may be configured to emit the signal in the direction of the coiled portion 422 (e.g., continuously or periodically) during movement of the door 428 to detect a change in distance 436 between a radially outermost portion of the coiled portion 422 and the time-of-flight sensor 145. Such a change in distance is indicative of a change in radius of the coiled portion 422, which in turn is indicative of a change in position of the bottom edge 438 of the door 428. With the change in radius of the coiled portion 422 over a known operation time of the movable barrier operator 424, the movable barrier operator system 410 is able to determine the speed, velocity, or acceleration of the movable barrier 420.

In addition to the sectional door 105 of FIGS. 6 and 7 and the roll-up movable barrier 420 of FIG. 12, other example movable barriers, such as vertical lift doors (e.g., single-piece doors that lift vertically without horizontal displacement or roll-up), fire doors, or fabric doors, may be provided with the movable barrier operator systems described herein.

Figure 13:
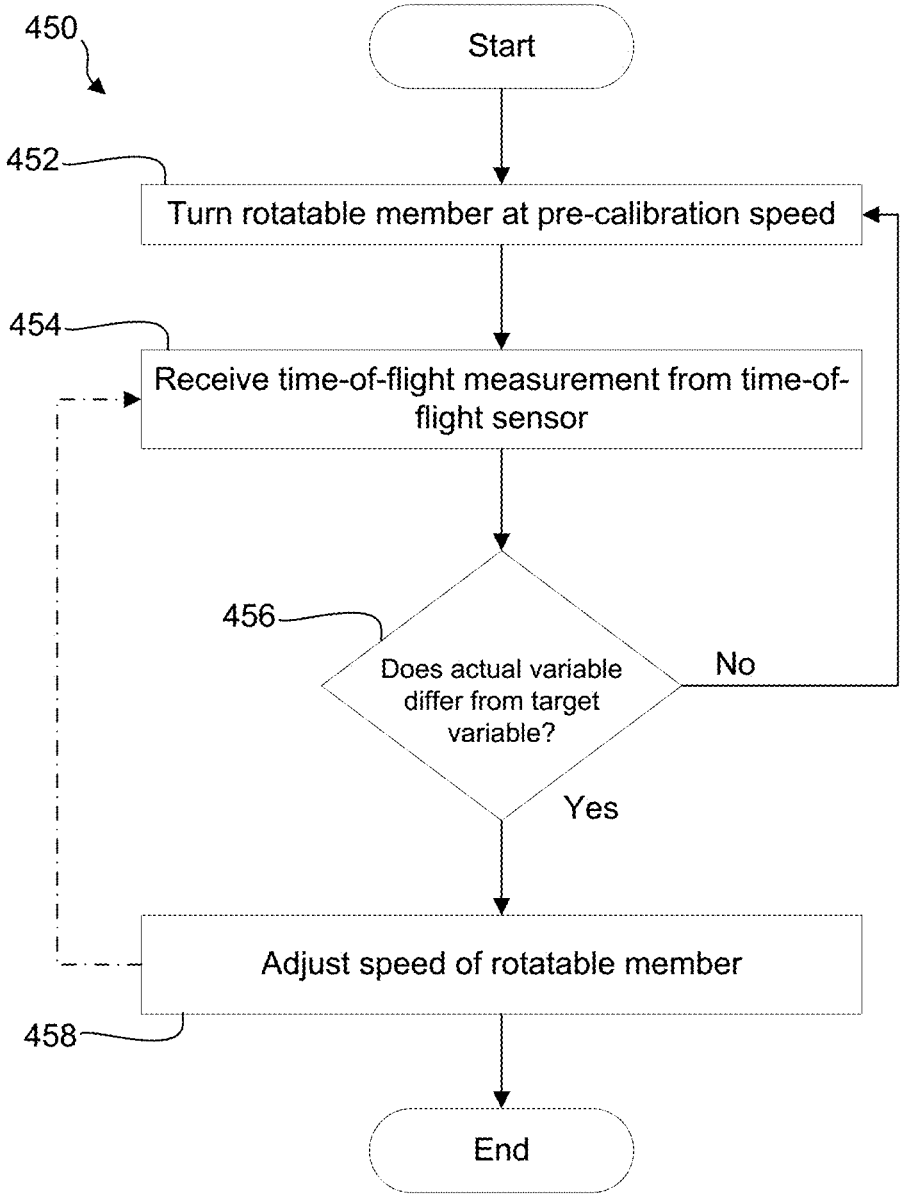
FIG. 13 is a flow chart of an example method that includes using the time-of-flight sensor of FIGS. 6 and 7 to monitor and control the motion of a movable barrier.

Referring to FIG. 13, a method 450 is provided for operating a movable barrier, such as door 105 in FIG. 6. One or more of the operations of the method 450 may be performed by the movable barrier operator 100 (e.g., at processor 160) and/or the movable barrier operator server computer 170. The method 450 includes causing 452 a variable speed drive 116 to turn a rotatable member at a pre-calibration speed to move a movable barrier; for example, from an open position toward a closed position, from a closed position toward an open closed position, from an intermediate position toward one of the open and closed positions, or between multiple intermediate positions. The pre-calibration speed corresponds to a target variable of the movable barrier.

The method 450 further includes receiving 454 a time-of-flight measurement associated with the movable barrier. The time-of-flight measurement may be received from a time-of-flight sensor, such as time-of-flight sensor 145B, 145C, or 145D. The time-of-flight measurement is indicative of an actual variable of the movable barrier. The actual variable of the movable barrier may include at least one of an actual position, actual direction, actual speed, and actual acceleration of the movable barrier.

In this way, the processor 160 is informed of an actual variable of the door 105 that may vary based on movement along the tracks 136 as related to a variable of the rotatable member 114. For example, the processor 160 may correlate the number of output rotations of the rotatable member 114 with a location of the door 105 (as informed by the time-of-flight sensor) along the tracks 136. In this example, the processor 160 is informed of the actual position of the door 105 after a given number of revolutions of the rotatable member 114. In another example, the processor 160 may correlate the output speed of the rotatable member 114 with an actual speed of the door 105. In this example, the processor 160 is informed of the actual speed of the door 105 at the various locations along the tracks 136.

The method 450 further includes determining 456 whether the actual variable of the movable barrier differs from a target variable. As previously discussed, the target variable may include, at least one of a target position, target direction, target speed, and target acceleration of the movable barrier. The actual variable may differ from the target variable if, for example, the actual variable is beyond an upper threshold or below a lower threshold. The upper and lower thresholds may be set relative to the target variable, such as an upper threshold that is 110% of the target variable and a lower threshold that is 90% of the target variable. In another example, the upper threshold is 105% of the target variable and a lower threshold is 95% of the target variable. As another example, the actual variable may differ from the target variable if the actual variable is between upper and lower thresholds but is trending, over a series of operations of the movable barrier operator, toward the upper or lower threshold.

As another example, the target variable may be a target position of the door. The actual variable may differ from the target variable if the actual position of the door is more than two position increments away from the target variable at a given time after initiation of the motor 110.

If the actual variable of the movable barrier does not differ from the target variable, the method 450 may return to step 452, wherein the processor 160 continues to cause the variable speed drive 116 to turn the rotatable member at the pre-calibration speed.

If the actual variable of the movable barrier differs from the target variable, the method 450 includes responsively causing 458 the variable speed drive 116 to adjust a rotational speed of the rotatable member. Optionally, the method 450 may return to step 454, wherein a subsequent time-of-flight measurement associated with the movable barrier is received. In this way, the method 450 may provide for continuous monitoring of the actual variable(s) of the movable barrier.

As an example, the motor 110 may be a variable speed motor. The processor 160 may identify, for one or more positions of the door, the relationships between the speeds the motor 110 could turn the rotatable member 114 and the resulting actual speeds of the door. The processor 160 may identify the relationships between door position, rotatable member 114 speed, and actual speed of the door using historical data gathered over operations of the movable barrier operator 400 and/or historical data from other movable barrier operators. Further, to continuously or periodically monitor the relationships between door position, motor speed, and door speed, the processor 160 may periodically adjust the speed the motor 110 turns the rotatable member 114 during opening/closing of the door, such as within a few percent of the calibrated speed, at the different positions of the door to observe the resulting actual speed of the door at each position. If, over time, the actual speed of the door at a particular position along the path of the door drops below an acceptable speed, the processor 160 may increase the speed the motor 110 turns the rotatable member 114 according to the learned relationships so that the actual speed of the door is acceptable.

In another aspect, the movable barrier operator system 400 and/or method 450 described herein may additionally or alternatively utilize sensors 145 other than a time-of-flight sensor 145B. For example, the installation sensor 300 described with respect to FIG. 5 may be utilized to inform a processor 160 of an actual variable of a door 105. More particularly, the support 306 may be connected to a track associated with the door 302 (e.g., the vertical portion 140 of the track 136 of FIGS. 6 and 7). As the door 302 travels from an open position to a closed position (or vice versa), the sensors 308 may detect one or more variables of the door 302. For example, the sensors 308 may be hall effect sensors that detect magnets temporarily installed on the door 305.

The installation sensor 300 may be in communication (e.g., direct or indirect communication) with the processor 160 such that the processor 160 is informed of an actual variable of the door 302 as the door 302 travels along the tracks 136. As discussed herein, the processor 160 is configured to cause the variable speed drive 116 (e.g., via the motor 110) to adjust a rotational speed of the rotatable member 114 to vary a travel speed of the door 302. For example, the processor 160 may be configured to cause the variable speed drive 116 to increase or decrease the pre-calibration rotational speed of the rotatable member 114. After calibration, one or more portions of the sensor 300 may be removed from the track 136. Alternatively, the sensor 300 may remain installed to allow for subsequent calibrations.

In some instances, the movable barrier operator system 400 may be installed in environments with factors that may affect door speed and may be difficult for a manufacturer of the movable barrier operator to control. For example, as discussed with respect to FIGS. 8-10, drums of various diameters, and drums having various tapering diameters, may be used to wind up and pay out cables 125, 130 that support a door 105. Furthermore, sprockets of various sizes may be used to couple the rotatable member 114 of the movable barrier operator 100 to the shaft 426 (see FIG. 12). For example, the shaft 426 may have a follower sprocket mounted thereon that is connected to a drive sprocket on the output shaft of the movable barrier operator 100 by a chain. The manufacturer of the movable barrier operator may not be able to predict the size and/or shape of the drum(s) and/or sprocket(s) an installer may utilize with the movable barrier operator. The movable barrier operator system 400 may monitor and adjust door speed to compensate for these factors and provide a desired operation of the associated movable barrier, such as by providing an actual door speed profile that matches a target door speed profile provided by the manufacturer.

The above disclosures may be applied in a variety of environments, contexts or uses/applications. For example, the movable barrier operator 100 may be a swinging gate operator, a sliding gate operator, or a garage door opener that utilizes a trolley as some examples.

While there have been illustrated and described particular embodiments of the present invention, those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept. For example, movable barrier operators disclosed herein may operate various types of doors, such as sectional doors, fabric doors, rolling shutters, high speed doors, cold storage doors, industrial sectional overhead doors, and rolling steel doors. It is intended that the phrase "at least one of" be interpreted in the disjunctive sense. For example, the phrase "at least one of A and B" is intended to encompass A, B, or both A and B.

What is claimed is:

1. A movable barrier operator system comprising:

a motor configured to turn a drum in a first direction to wind up a cable on the drum and move a door connected to the cable from a closed position toward an open position, the motor configured to turn the drum in an opposite, second direction to pay out the cable from the drum and permit the door to move from the open position toward the closed position;

a memory configured to store an expected variable of the door associated with acceptable movement of the door from the open position toward the closed position;

a sensor configured to directly sense a portion of the door;

communication circuitry to receive a close command;

a processor circuit operatively coupled to the motor, the memory, the sensor, and the communication circuitry, the processor circuit configured to cause the motor to turn the drum in the second direction to pay out the cable and permit the door to move from the open position toward the closed position upon the communication circuitry receiving the close command;

the processor circuit configured to determine, via the sensor directly sensing the portion of the door, a first position of the portion of the door and a second position of the portion of the door as the motor turns the drum in the second direction to permit the door to move from the open position toward the closed position;

the processor circuit configured to use the sensor to estimate an actual variable of the door based upon a difference between the first position and the second position of the portion of the door:

the processor circuit configured to determine whether the actual variable is acceptable based at least in part on the processor circuit causing the motor to turn the drum in the second direction to pay out the cable and the expected variable of the door; and the processor circuit configured to change operation of the motor upon the actual variable of the door determined to be unacceptable.

2. The movable barrier operator system of claim 1 wherein the actual variable of the door includes a speed of the door and the expected variable of the door includes a threshold speed; and the processor circuit is configured to determine the actual variable of the door is unacceptable in response to determining that the speed of the door is less than the threshold speed.

3. The movable barrier operator system of claim 1 wherein the sensor includes a camera configured to capture images of the door.

4. The movable barrier operator system of claim 1 wherein the sensor includes a camera operable to capture a first image of the portion of the door in the first position thereof and capture a second image of the portion of the door in the second position thereof.

5. The movable barrier operator system of claim 1 wherein the processor circuit is configured to determine the expected variable of the door based at least in part upon one or more variables associated with operation of the motor.

6. The movable barrier operator system of claim 1 wherein the actual variable of the door is at least one of:

a speed of the door;

an acceleration of the door; and a direction of movement of the door.

7. The movable barrier operator system of claim 1 wherein the sensor is configured to detect a machine-readable indicium on the portion of the door; and wherein the processor circuit is configured to estimate the actual variable of the door based at least in part on the detected machine-readable indicium of the door.

8. The movable barrier operator system of claim 1 wherein the processor circuit is configured to change operation of the motor by at least one of stopping the motor, slowing operation of the motor, and reversing operation of the motor.

9. The movable barrier operator system of claim 1 wherein the processor circuit is configured to cause the motor to turn the drum in the second direction for a period of time to pay out the cable and permit the door to move from the open position toward the closed position;

wherein the processor circuit is configured to:

determine, via the sensor directly sensing the portion of the door, the first position of the door at a first time during the period of time; and determine, via the sensor directly sensing the portion of the door, the second position of the door at a second time during the period of time.

10. The movable barrier operator system of claim 1 wherein the sensor comprises a camera.

11. The movable barrier operator system of claim 1 wherein the sensor comprises a hall effect sensor.

12. The movable barrier operator system of claim 1 wherein the sensor comprises a proximity sensor.

13. A non-transitory computer readable medium having instructions stored thereon that, when executed by a processor circuit of a movable barrier operator system, cause the processor circuit to perform operations comprising:

operating a motor of the movable barrier operator system to turn a drum and pay out a cable from the drum to permit a door connected to the drum to move from an open position toward a closed position;

using a sensor to directly sense a portion of the door as the motor turns the drum to pay out the cable;

determining a first position of the portion of the door via the sensor directly sensing the portion of the door as the motor turns the drum to pay out the cable;

determining a second position of the portion of the door via the sensor directly sensing the portion of the door as the motor turns the drum to pay out the cable;

estimating an actual variable of the door based upon a difference between the first position and the second position of the portion of the door;

determining whether the actual variable of the door is acceptable based at least in part upon the difference between the actual variable of the door and an expected variable of the door; and changing operation of the motor upon the actual variable of the door being unacceptable.

14. The non-transitory computer readable medium of claim 13 wherein the actual variable of the door includes a speed of the door and the expected variable of the door is a threshold speed; and wherein determining whether the actual variable of the door is acceptable includes determining whether the speed of the door is less than the threshold speed.

15. The non-transitory computer readable medium of claim 13 wherein the sensor includes a camera and using the sensor to estimate the actual variable of the door includes operating the camera to capture images of the door.

16. A movable barrier operator system comprising:

a time-of-flight sensor configured to emit a signal and measure a distance based on a time-of-flight of the signal, the distance corresponding to a position of a door;

a variable speed drive having a rotatable member configured to be connected to the door so that turning of the rotatable member moves the door between an open position and a closed position;

a memory configured to store a target variable of the door;

a processor circuit operably coupled to the time-of-flight sensor, the variable speed drive, and the memory, the processor circuit configured to cause the variable speed drive to turn the rotatable member at a pre-calibration speed that corresponds to the target variable;

the processor circuit configured to determine an actual variable of the door based at least in part upon the distance measured using the time-of-flight of the signal;

the processor circuit configured to cause the variable speed drive to adjust a speed of turning the rotatable member in response to a difference between the target variable and the actual variable of the door;

wherein the memory is configured to store a plurality of speeds for the rotatable member and the target variable includes a plurality of target variables corresponding to the speeds for the rotatable member;

wherein the processor circuit is configured to determine a plurality of actual variables of the door at different positions of the door; and wherein the processor circuit is configured to cause the variable speed drive to adjust the speed of turning of the rotatable member upon differences between the target variables and the actual variables for at least two positions of the different positions.

17. The movable barrier operator system of claim 16, wherein the target variable includes a target position of the door and the actual variable includes an actual position of the door.

18. The movable barrier operator system of claim 16, wherein the memory is configured to store the pre-calibration speed; and wherein the processor circuit is configured to change the pre-calibration speed stored in the memory based at least in part on the processor circuit causing the variable speed drive to adjust the speed of turning the rotatable member.

19. The movable barrier operator system of claim 16, wherein the processor circuit is configured to cause the variable speed drive to increase the speed of turning the rotatable member in response to the actual variable being less than the target variable; and wherein the processor circuit is configured to cause the variable speed drive to decrease the speed of turning the rotatable member in response to the actual variable exceeding the target variable.

20. The movable barrier operator system of claim 16 wherein the time-of-flight sensor is configured to emit a light signal.

21. The movable barrier operator system of claim 16 wherein the processor circuit is configured to use time-of-flight information from the time-of-flight sensor to determine a distance of the door from at least one of the open position and the closed position of the door.

22. The movable barrier operator system of claim 16 wherein the processor circuit is configured to use time-of-flight information from the time-of-flight sensor to determine a distance between the time-of-flight sensor and either the door or a floor.

23. The movable barrier operator system of claim 16 further comprising the door and a shaft coupled to the rotatable member of the variable speed drive, the door configured to be wound onto the shaft with turning of the rotatable member in a first direction and configured to be payed out from the shaft with turning of the rotatable member in an opposite, second direction; and wherein the processor circuit is configured to use time-of-flight information from the time-of-flight sensor to determine a distance between the time-of-flight sensor and a portion of the door wound onto the shaft.

24. The movable barrier operator system of claim 16 further comprising the door, a drum connected to the rotatable member, and a flexible, elongate member connecting the door and the drum, wherein the drum includes a frustoconical portion having a variable radius windup surface about which the elongate member is configured to be wound up onto or payed out from to at least support corresponding movement of the door connected to the elongate member.

25. The movable barrier operator system of claim 16 wherein the processor circuit is further configured to effect an error condition annunciation to a user when the actual variable is not the target variable.

26. The movable barrier operator system of claim 16 wherein the processor circuit is further configured to deactivate an auxiliary device in response to determining the door is in the closed position.

* * * * *